US008984986B2

(12) United States Patent
Inuzuka et al.

(10) Patent No.: US 8,984,986 B2
(45) Date of Patent: Mar. 24, 2015

(54) ACCELERATOR APPARATUS FOR VEHICLE

(71) Applicant: Denso Corporation, Kariya, Aichi-pref (JP)

(72) Inventors: Yoshinori Inuzuka, Okazaki (JP); Masahiro Makino, Kariya (JP)

(73) Assignee: Denso Corporation, Kariya (JP)

( * ) Notice: Subject to any disclaimer, the term of this patent is extended or adjusted under 35 U.S.C. 154(b) by 174 days.

(21) Appl. No.: 13/688,559

(22) Filed: Nov. 29, 2012

(65) Prior Publication Data

US 2013/0133466 A1 May 30, 2013

(30) Foreign Application Priority Data

Nov. 30, 2011 (JP) ..... 2011-262075
Mar. 30, 2012 (JP) ..... 2012-79748

(51) Int. Cl.
*G05G 1/44* (2008.04)
*G05G 5/03* (2008.04)

(52) U.S. Cl.
CPC ... *G05G 1/44* (2013.01); *G05G 5/03* (2013.01)
USPC ..... 74/513; 74/512; 74/560

(58) Field of Classification Search
USPC ..... 74/512–514, 560
See application file for complete search history.

(56) References Cited

U.S. PATENT DOCUMENTS

| | | | | |
|---|---|---|---|---|
| 1,330,986 | A * | 2/1920 | Rice | 74/513 |
| 8,281,685 | B2 * | 10/2012 | Makino | 74/512 |
| 2006/0112931 | A1 * | 6/2006 | Meguro | 123/399 |
| 2007/0240534 | A1 * | 10/2007 | Makino | 74/513 |

FOREIGN PATENT DOCUMENTS

| | | | |
|---|---|---|---|
| DE | 102008002313 | A1 * | 1/2009 |
| JP | 11-350985 | | 12/1999 |
| JP | 2003211994 | A * | 7/2003 |
| JP | 2004-092492 | | 3/2004 |
| JP | 2007-190939 | | 8/2007 |
| JP | 2010-158992 | | 7/2010 |

* cited by examiner

*Primary Examiner* — Daniel Yabut
(74) *Attorney, Agent, or Firm* — Nixon & Vanderhye P.C.

(57) ABSTRACT

A pedal boss, to which an accelerator pedal is fixed, has a projection-receiving space, which circumferentially extends on a circumferential side of a closing-side end wall in an accelerator-opening direction and receives a projection. When the pedal boss is rotated in an accelerator-closing direction, the pedal boss is rotatable to an accelerator-full-closing position of the pedal boss without being stopped by the projection through engagement with the projection regardless of a rotational position of the projection.

10 Claims, 12 Drawing Sheets

ACCELERATOR APPARATUS FOR VEHICLE

CROSS REFERENCE TO RELATED APPLICATION

This application is based on and incorporates herein by reference Japanese Patent Application No. 2011-262075 filed on Nov. 30, 2011 and Japanese Patent Application No. 2012-79748 filed on Mar. 30, 2012.

TECHNICAL FIELD

The present disclosure relates to an accelerator apparatus for a vehicle.

BACKGROUND

In an accelerator apparatus of an electronic type, the amount of depression of an accelerator pedal is sensed with a sensor, and the sensor outputs an electrical signal, which indicates the sensed amount of depression of the accelerator pedal, to an electronic control device. The electronic control device drives a throttle valve based on the sensed amount of depression of the accelerator pedal and other information.

JP2010-158992A teaches an accelerator apparatus of an electronic type, which includes a pedal rotor and a return rotor that are rotatably supported by a shaft. An accelerator pedal, which is depressible by a foot of a driver of the vehicle, is connected to the pedal rotor to rotate integrally therewith. When the accelerator pedal is depressed by the foot of the driver to rotate the pedal rotor from an accelerator-full-closing position, which corresponding to an idling state of an engine, in an accelerator-opening direction, the pedal rotor and the return rotor are urged away from each other in an axial direction of the shaft.

In the state where the pedal rotor and the return rotor are urged away from each other in the axial direction of the shaft, the pedal rotor axially urges a first friction member, which is fixed to the pedal rotor, against the support member. Thereby, the pedal rotor receives a resistance torque through the first friction member. Furthermore, the return rotor urges a second friction member, which is axially placed between the return rotor and the support member, against the support member. Thereby, the return rotor receives a resistance torque through the second friction member. These resistance torques act to maintain the rotation of the accelerator pedal connected to the pedal rotor and generate the pedal force hysteresis characteristics such that the pedal force, which is applied to the accelerator pedal at the time of releasing the accelerator pedal, is smaller than the pedal force, which is applied to the accelerator pedal at the time of depressing the accelerator pedal.

In the accelerator apparatus of JP2010-158992A, when a foreign object is clamped between the first friction member and the support member or between the return rotor and the second friction member or when the frictional force of each friction member is increased due to an environmental change, the first friction member may be fastened (jammed) to the support member, and/or the second friction member may be fastened (jammed) to the return rotor. When at least one of the first friction member and the second friction member is fastened, the accelerator pedal may not be returned to the accelerator-full-closing position. Thereby, in such a state, when the depressed accelerator pedal is released by removing the foot of the driver from the accelerator pedal, the engine may not be returned to the idling state.

SUMMARY

The present disclosure is made in view of the above disadvantages.

According to the present disclosure, there is provided an accelerator apparatus for a vehicle. The accelerator apparatus includes a support member, a shaft, a pedal boss, an accelerator pedal, a first urging device, a rotational angle sensing device, a first rotor, a second rotor, a projection, a plurality of first-bevel-gear teeth, a plurality of second-bevel-gear teeth, a second urging device, a first friction member and a second friction member. The support member is installable to a body of the vehicle. The shaft is rotatably installed to the support member. The pedal boss is placed coaxial with the shaft and is rotatable integrally with the shaft. The accelerator pedal is fixed to the pedal boss and is rotatable integrally with the pedal boss in both of an accelerator-closing direction and an accelerator-opening direction, which are circumferentially opposite to each other, in response to an amount of depression of the accelerator pedal. The first urging device urges the pedal boss in the accelerator-closing direction. The rotational angle sensing device senses a rotational angle of the shaft relative to the support member. The first rotor is placed radially outward of the shaft and is rotatable relative to the pedal boss. The second rotor is placed radially outward of the shaft and is located on an axial side of the first rotor, which is opposite from the pedal boss. The second rotor is rotatable relative to the first rotor. The projection is formed integrally with the first rotor and axially projects from the first rotor on an axial side of the first rotor where the pedal boss is located. The projection is circumferentially engageable with an engaging portion provided in the pedal boss. The first-bevel-gear teeth are formed integrally with the first rotor and axially project from the first rotor on the axial side of the first rotor where the second rotor is located. An amount of axial projection of each of the plurality of first-bevel-gear teeth, which is measured in an axial direction of the shaft toward the second rotor, progressively increases in the accelerator-closing direction. The second-bevel-gear teeth are formed integrally with the second rotor and axially project from the second rotor on an axial side of the second rotor where the first rotor is located. An amount of axial projection of each of the plurality of second-bevel-gear teeth, which is measured in the axial direction of the shaft toward the first rotor, progressively increases in the accelerator-opening direction. When the first rotor is circumferentially positioned on a circumferential side of an accelerator-full-closing position of the first rotor where an accelerator-full-opening position of the first rotor is located, the plurality of second-bevel-gear teeth engages the plurality of first-bevel-gear teeth, respectively, to urge the first rotor and the second rotor away from each other in the axial direction of the shaft. The second urging device urges the second rotor in the accelerator-closing direction. The first friction member is placed between the projection and the support member in the axial direction of the shaft. When the first rotor is urged away from the second rotor in the axial direction of the shaft, the first friction member is frictionally engaged with the projection or the support member to apply a resistance torque to the projection. The second friction member is placed between the second rotor and the support member in the axial direction of the shaft. When the second rotor is urged away from the first rotor in the axial direction of the shaft, the second friction member is frictionally engaged with the second rotor or the support member to apply a resistance torque to the second rotor. The pedal boss has a projection-receiving space, which circumferentially extends on a circumferential side of the engaging portion in the accelerator-opening direction and receives the projection. When the pedal boss is rotated in the accelerator-closing direction, the pedal boss is rotatable to an accelerator-full-closing position of the pedal boss without being stopped by the projection through engagement with the projection regardless of a rotational position of the projection.

BRIEF DESCRIPTION OF THE DRAWINGS

The drawings described herein are for illustration purposes only and are not intended to limit the scope of the present disclosure in any way.

DETAILED DESCRIPTION

Figure 1:
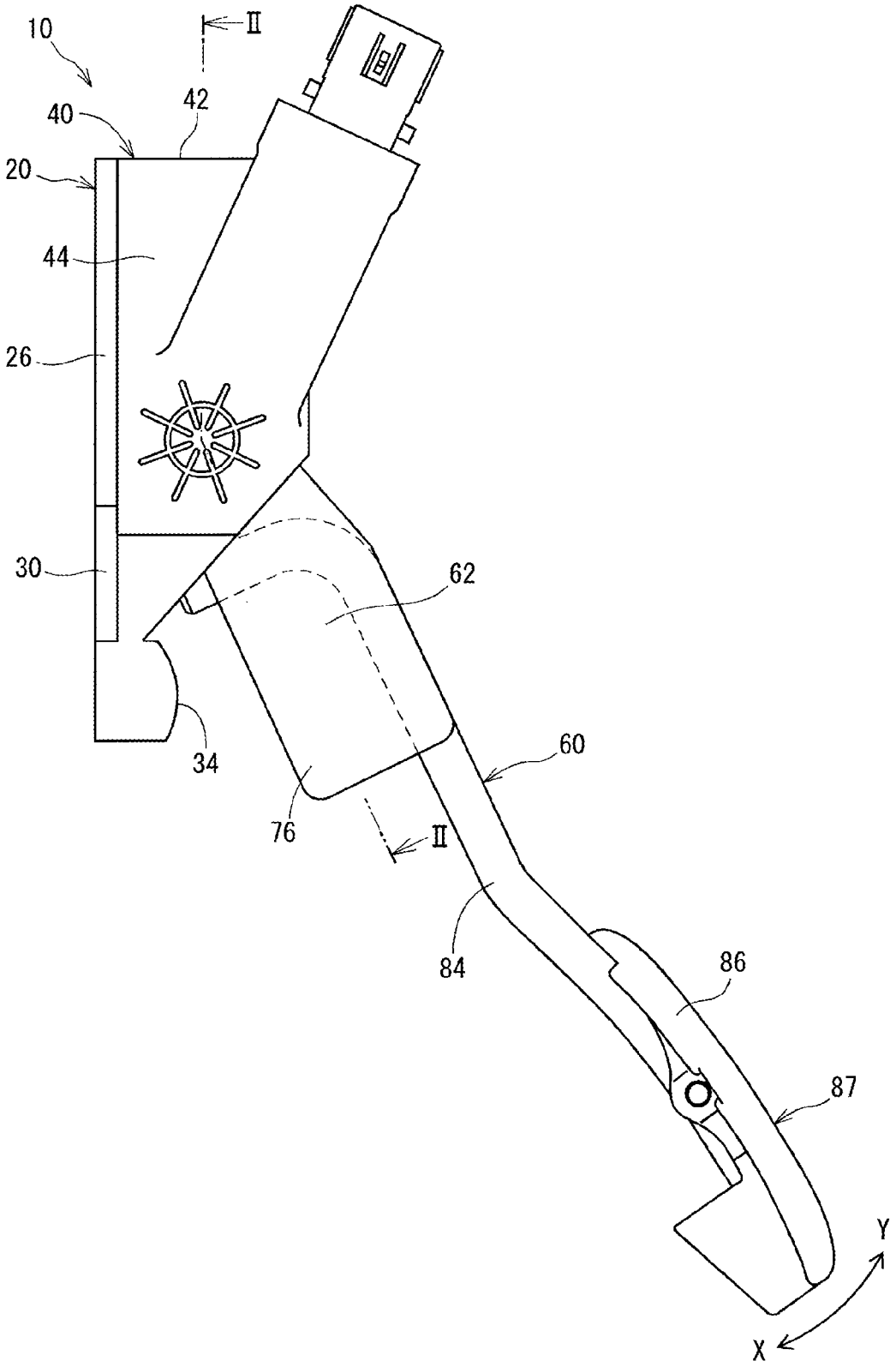
FIG. 1 is a schematic side view showing an entire structure of an accelerator apparatus according to a first embodiment of the present disclosure.
Figure 2:
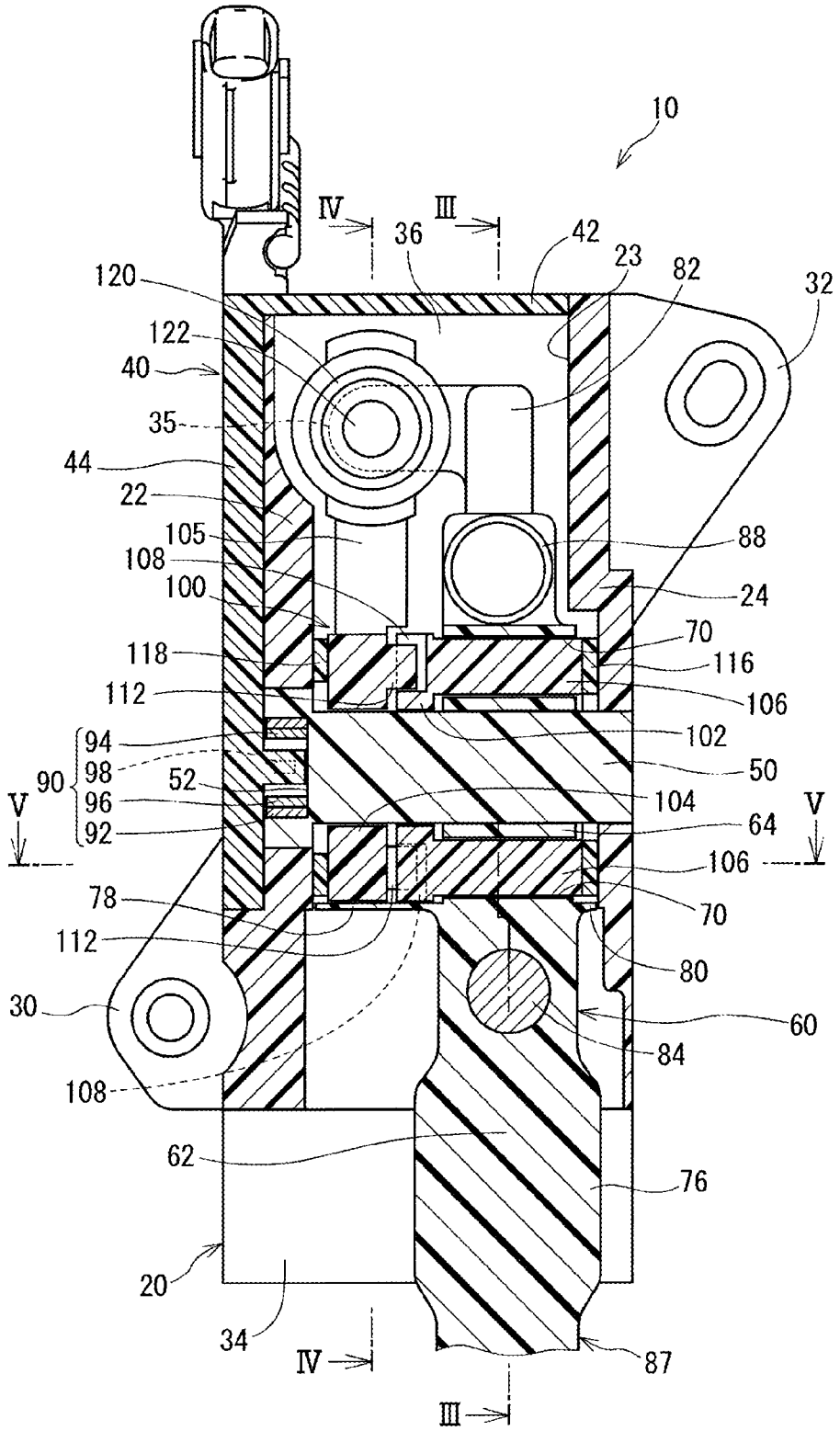
FIG. 2 is a cross sectional view taken along line II-II in FIG. 1.

Various embodiments of the present disclosure will be described with reference to the accompanying drawings.

First Embodiment

FIGS. 1 to 4 show an accelerator apparatus according to a first embodiment of the present disclosure. The accelerator apparatus 10 is an input apparatus, which is manipulated by a driver of a vehicle (automobile) to determine a valve opening degree of a throttle valve of an internal combustion engine of the vehicle (not shown). The accelerator apparatus 10 is an accelerator apparatus of an electronic type and transmits an electric signal, which indicates an amount of depression of an accelerator pedal 87, to an electronic control device. The electronic control device drives the throttle valve through a throttle actuator (not shown) based on the amount of depression of the accelerator pedal 87 and the other information.

The accelerator apparatus 10 of FIGS. 1 to 4 are indicated in its installed position relative to a vehicle body (not shown). In the following description, for the descriptive purpose, the upper side of FIGS. 1 to 4 will be described as an upper side, and the lower side of FIGS. 1 to 4 will be described as a lower side. Furthermore, the right side of FIG. 1 will be described as a rear side, and the left side of FIG. 1 will be described as a front side.

The accelerator apparatus 10 includes a housing 20, a cover 40, a shaft 50, a manipulation member 60, a first spring 88, a rotational position sensor 90 and a pedal force hysteresis mechanism 100. The housing 20 and the cover 40 serve as a support member of the present disclosure. The first spring 88 serves as a first urging device (a first urging means). The rotational position sensor 90 serves as a rotational angle sensing device (a rotational angle sensing means) of the present disclosure.

The housing 20 includes two bearing portions (left and right bearing portions) 22, 24, a connecting portion (a front side connecting portion) 26, a connecting portion (a rear side connecting portion) 28, two installation portions (left and right installation portions) 30, 32 and a full-opening-side stopper portion 34. The two bearing portions 22, 24 are spaced from each by a predetermined distance and are opposed to each other in an axial direction of the shaft 50. The connecting portion 26 connects between a front part of the bearing portion 22 and a front part of the bearing portion 24. The connecting portion 28 connects between a rear part of the bearing portion 22 and a rear part of the bearing portion 24. The installation portion 30 is formed integrally with a left side of the connecting portion 26, and the installation portion 32 is formed integrally with a right side of the connecting portion 26. The full-opening-side stopper portion 34 is formed integrally with a lower part of the connecting portion 26. The installation portions 30, 32 are installable to the vehicle body (not shown) with, for example, bolts, respectively. When the full-opening-side stopper portion 34 contacts the manipulation member 60, as indicated by a dot-dot-dash line in FIG. 3, the rotation of the manipulation member 60 and associated components rotated therewith is stopped at an accelerator-full-opening position. The accelerator-full-opening position is a position, at which the amount of depression of the manipulation member 60 by the driver is in the full amount, i.e., the accelerator opening degree is 100% (full opening position).

The cover 40 includes a covering portion 42 and a fixing portion 44. The covering portion 42 closes an upper opening of the housing 20. The fixing portion 44 extends downward from an end part of the covering portion 42, which is located on a side where the bearing portion 22 is located.

One end portion of the shaft 50 is rotatably supported by the bearing portion 22 of the housing 20, and the other end portion of the shaft 50 is rotatably supported by the bearing portion 24 of the housing 20. A sensor receiving recess 52 is formed in a center part of the one end portion of the shaft 50, and a sensing device of the rotational position sensor 90 is received in the sensor receiving recess 52.

Figure 3:
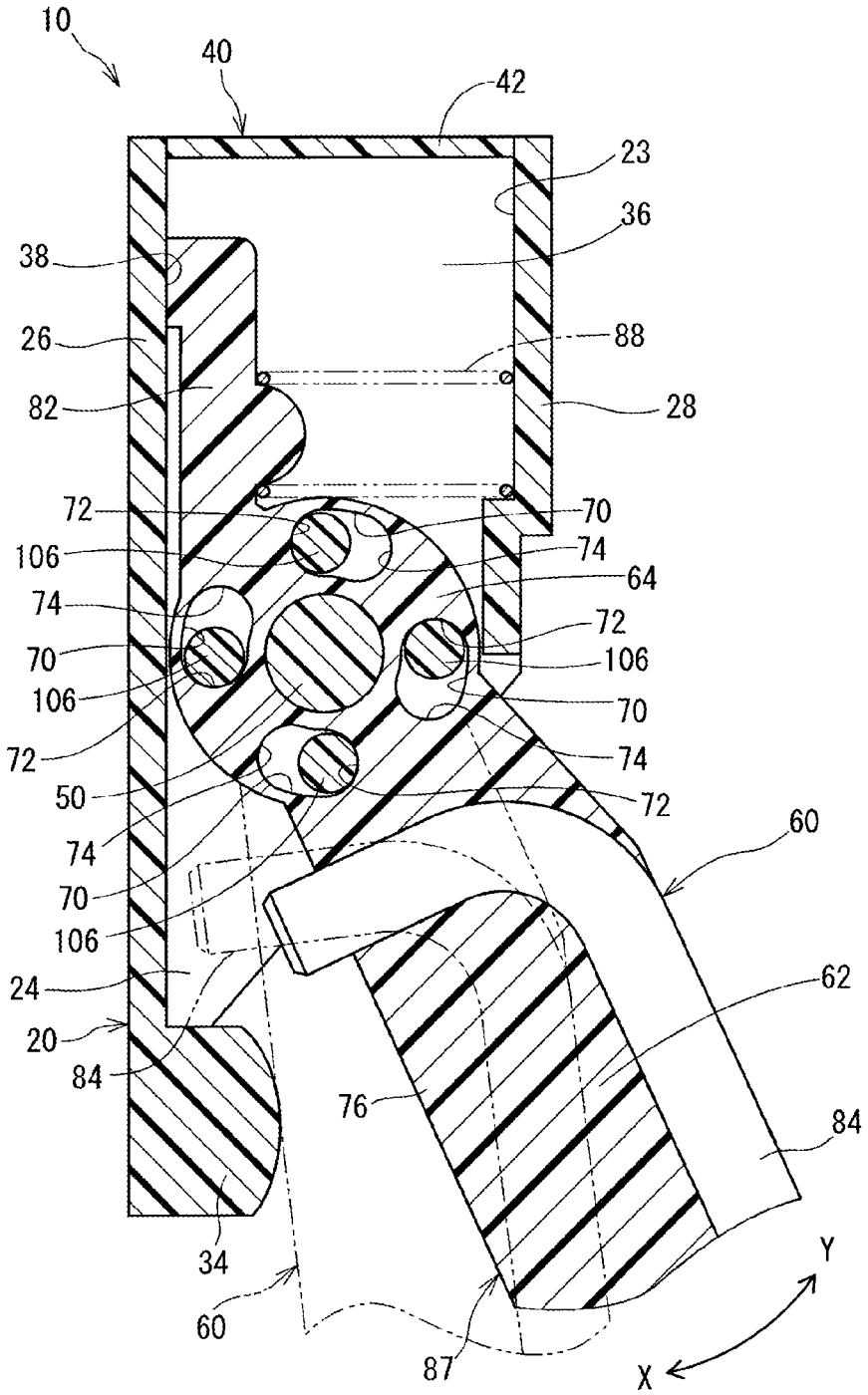
FIG. 3 is a cross sectional view taken along line III-III in FIG. 2.
Figure 4:
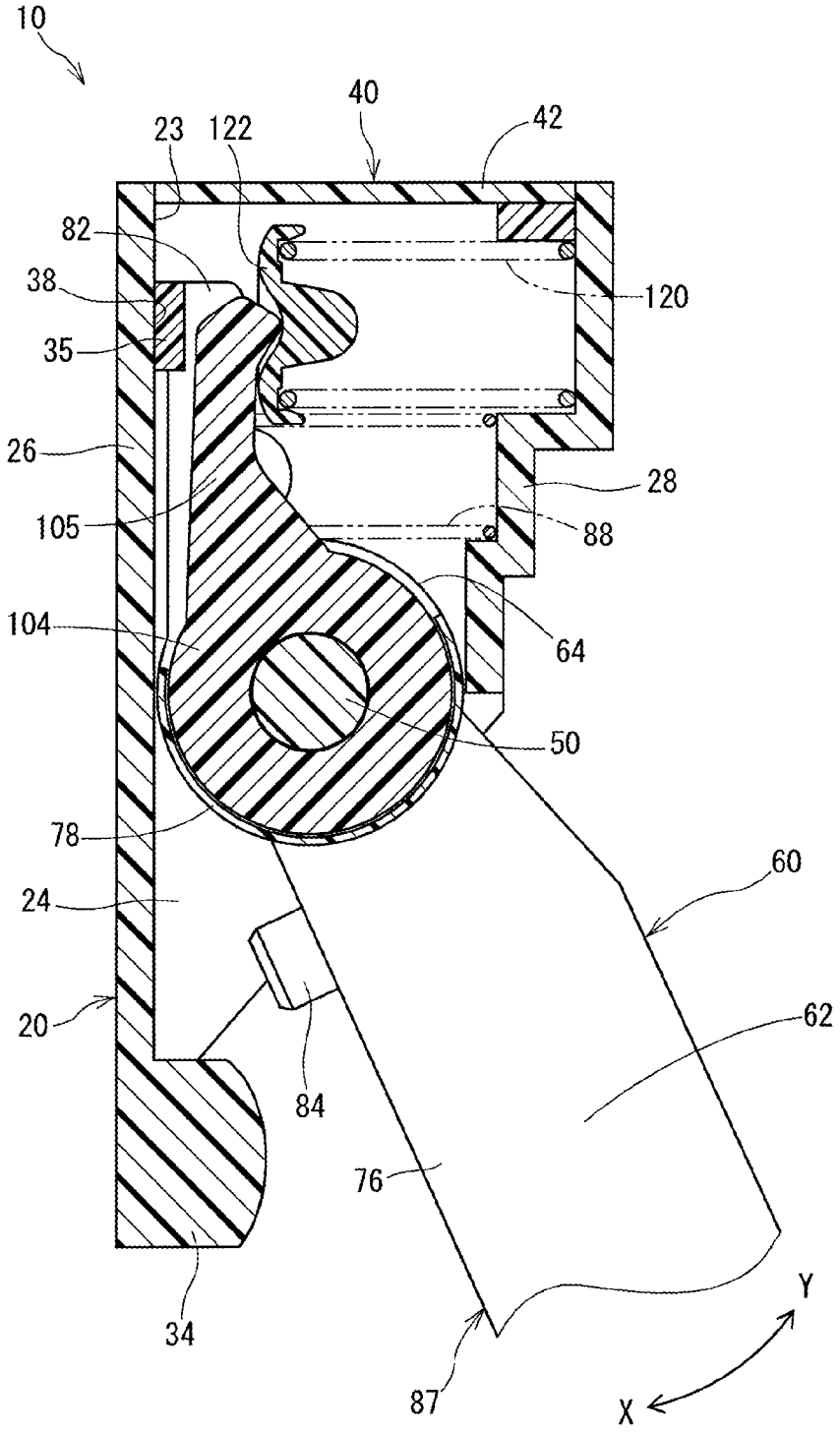
FIG. 4 is a cross sectional view taken along line IV-IV in FIG. 2.

The shaft 50 (together with the pedal boss portion 64) is rotatable through a predetermined angular range from an accelerator-full-closing position of the shaft 50 (and of the manipulation member 60) to an accelerator-full-opening position of the shaft 50 (and of the manipulation member 60). The accelerator-full-closing position is a position, at which the amount of depression of the manipulation member 60 by the driver is zero, i.e., the accelerator opening degree is 0% (full closing position). In FIG. 3, the accelerator-full-closing position of the manipulation member 60 is indicated by a solid line, and the accelerator-full-opening position of the manipulation member 60 is indicated by the dot-dot-dash line.

Hereinafter, the rotational direction of the manipulation member 60 and the associated components thereof from the accelerator-full-closing position toward the accelerator-full-opening position will be referred to an accelerator-opening direction X. Furthermore, the rotational direction of the manipulation member 60 and the associated components thereof from the accelerator-full-opening position toward the accelerator-full-closing position will be referred to an accelerator-closing direction Y. The associated components, which are rotated integrally with the manipulation member 60, include a first rotor 102 and a second rotor 104, which will be described in detail later.

The manipulation member 60 includes a rotatable body 62, a rod 84 and a pad 86. The rotatable body 62 includes a pedal boss portion 64, a rod-connecting portion 76, two cover portions 78, 80 and a full-closing-side stopper portion 82. The rod-connecting portion 76, the rod 84 and the pad 86 form the accelerator pedal 87. The pedal boss portion 64 serves as a pedal boss of the present disclosure. The full-closing-side stopper portion 82 serves as a full-closing side stopper of the present disclosure.

The pedal boss portion 64 is configured into an annular form (i.e., a cylindrical tubular form) and is fixed to an outer peripheral wall of the shaft 50 by, for example, press-fitting at a location between the bearing portion 22 and the bearing portion 24 of the housing 20. The cover portion 78 is configured into an arcuate form, which projects from a peripheral edge of an end surface (a bearing portion 22 side end surface) of the pedal boss portion 64 toward the bearing portion 22. The cover portion 80 is configured into an arcuate form, which projects from a peripheral edge of an end surface (a bearing portion 24 side end surface) of the pedal boss portion 64 toward the bearing portion 24. One end part of the rod-connecting portion 76 is connected to the pedal boss portion 64, and the other end portion of the rod-connecting portion 76 extends downward from a lower opening of the housing 20.

The pedal boss portion 64 and the cover portions 78, 80 close the lower opening of the housing 20, more specifically an accommodating portion 23. The housing 20 and the cover 40 form the accommodating portion 23, in which an accommodating chamber 36 is formed. The accommodating chamber 36 receives the full-closing-side stopper portion 82 of the manipulation member 60 and the pedal force hysteresis mechanism 100.

The full-closing-side stopper portion 82 is formed integrally with the pedal boss portion 64 such that the full-closing-side stopper portion 82 extends upwardly in the accommodating chamber 36 of the pedal boss portion 64. The full-closing-side stopper portion 82 is located in an upper side area of the accommodating chamber 36. When the full-closing-side stopper portion 82 contacts the inner wall (a wall extending in a top-to-bottom-direction) of the connecting portion 26 of the housing 20, the full-closing-side stopper portion 82 limits the rotation of the manipulation member 60 and the associated components thereof in the accelerator-closing direction Y at the accelerator-full-closing position. When the full-closing-side stopper portion 82 contacts the inner wall of the connecting portion 26 of the housing 20, the full-closing-side stopper portion 82 contacts a vertical surface 38 of the inner wall of the connecting portion 26, which extends in the top-to-bottom direction in FIG. 3.

One end portion of the rod 84 is fixed to the rod-connecting portion 76, and the other end portion of the rod 84 extends downward. The rod 84 is insert molded integrally with the rotatable body 62 at the time of molding the rotatable body 62 with resin. The pad 86 is fixed to the other end portion of the rod 84.

The driver of the vehicle depresses the pad 86 to manipulate the accelerator pedal 87. The accelerator pedal 87 converts a pedal force of the driver applied to the accelerator pedal 87 into a torque and conducts the converted torque to the shaft 50.

When the accelerator pedal 87 is rotated in the accelerator-opening direction X, a rotational angle of the shaft 50 in the accelerator-opening direction X relative to the accelerator-full-closing position, which serves as a reference point, is increased. Thereby, the accelerator opening degree, which corresponds to this rotational angle, is also increased. Furthermore, when the accelerator pedal 87 is rotated in the accelerator-closing direction Y, the rotational angle of the shaft 50 is reduced, and thereby the accelerator opening degree is reduced.

One end portion of the first spring 88, which is formed as a coil spring, is engaged with the full-closing-side stopper portion 82 of the manipulation member 60, and the other end portion of the first spring 88 is engaged with the connecting portion 28 of the housing 20. The first spring 88 urges the manipulation member 60 in the accelerator-closing direction Y. The urging force, which is exerted from the first spring 88 against the manipulation member 60, is increased, when the rotational angle of the manipulation member 60 is increased, i.e., when the rotational angle of the shaft 50 is increased. Furthermore, the urging force is set to enable returning of the manipulation member 60 and the associated components thereof, such as the shaft 50, to the accelerator-full-closing position regardless of the rotational position of the manipulation member 60.

The rotational position sensor 90 includes a yoke 92, two permanent magnets 94, 96 and a Hall element 98. The yoke 92 is made of a magnetic material and is configured into a tubular form. The yoke 92 is fixed to an inner wall of the sensor receiving recess 52 of the shaft 50. The magnet 94 and the magnet 96 are located radially inward of the yoke 92 and are diametrically opposed to each other about the rotational axis of the shaft 50. The magnets 94, 96 are fixed to the inner peripheral wall of the yoke 92. The Hall element 98 is placed between the magnet 94 and the magnet 96 and is installed to a circuit board (not shown), which is fixed to the housing 20.

When a magnetic field is applied to the Hall element 98, through which an electric current flows, a voltage is generated in the Hall element 98. This phenomenon is referred to as a Hall effect. A density of a magnetic flux, which penetrates through the Hall element 98, changes when the shaft 50 and the magnets 94, 96 are rotated about the shaft 50. A value of the voltage discussed above is proportional to the density of the magnetic flux, which penetrates through the Hall element 98. The rotational position sensor 90 senses the relative rotational angle of the Hall element 98 and the magnets 94, 96, i.e., the relative rotational angle of the shaft 50 relative to the housing 20 by sensing the voltage, which is generated in the Hall element 98. The rotational position sensor 90 outputs an electrical signal, which indicates the sensed relative rotational angle, to the electronic control device.

With reference to FIGS. 1 to 5, the pedal force hysteresis mechanism 100 includes the first rotor 102, the second rotor 104, a plurality of projections 106, a plurality of first-bevel-gear teeth 108, a plurality of second-bevel-gear teeth 112, a first friction member 116, a second friction member 118 and a second spring 120. The second spring 120 may serve as a second urging device (a second urging means) of the present disclosure.

The first rotor 102 is located radially outward of the shaft 50 and is rotatably supported by the shaft 50. The first rotor 102 is placed between the pedal boss portion 64 of the manipulation member 60 and the bearing portion 22 of the housing 20 in the axial direction of the shaft 50. The first rotor 102 is configured into an annular form (a cylindrical tubular form) and is rotatable relative to the shaft 50 and the pedal boss portion 64. Furthermore, the first rotor 102 is movable toward and away from the pedal boss portion 64 in the axial direction of the shaft 50.

The second rotor 104 is located radially outward of the shaft 50 and is rotatably supported by the shaft 50. The second rotor 104 is placed between the first rotor 102 and the bearing portion 22 of the housing 20 in the axial direction of the shaft 50. The second rotor 104 is configured into an annular form (a cylindrical tubular form) and is rotatable relative to the shaft 50 and the first rotor 102. Furthermore, the second rotor 104 is movable toward and away from the bearing portion 22 of the housing 20 in the axial direction of the shaft 50.

The projections 106 are formed integrally with an outer wall of the first rotor 102, which is located on the pedal boss portion 64 side in the axial direction of the shaft 50. The pedal boss portion 64 includes a plurality of through-holes 70 (each through-hole 70 defining a projection-receiving space 70*a*, which receives the corresponding projection 106). The projections 106 are received through the through-holes 70, respectively, and project toward the axial side, which is opposite from the first rotor 102. In the present embodiment, the number of the projections 106 is four, and these four projections 106 are arranged one after another at generally equal intervals in the circumferential direction. Each projection 106 is circumferentially engageable (contactable) with a closing-side end wall 72 of the corresponding through-hole 70 in the accelerator-closing direction Y. The closing-side end wall 72 of the through-hole 70 serves as an engaging portion of the present disclosure.

The closing-side end wall 72 of each through-hole 70 and the corresponding projection 106 can engage with each other in the circumferential direction to transmit the rotation (rotational force) between the manipulation member 60 and the first rotor 102. That is, the rotation of the manipulation member 60 in the accelerator-opening direction X can be conducted to the first rotor 102 through the closing-side end wall 72 of the through-hole 70 and the projection 106. Furthermore, the rotation of the first rotor 102 in the accelerator-closing direction Y can be conducted to the manipulation member 60 through the projection 106 and the closing-side end wall 72 of the through-hole 70.

Figure 5:
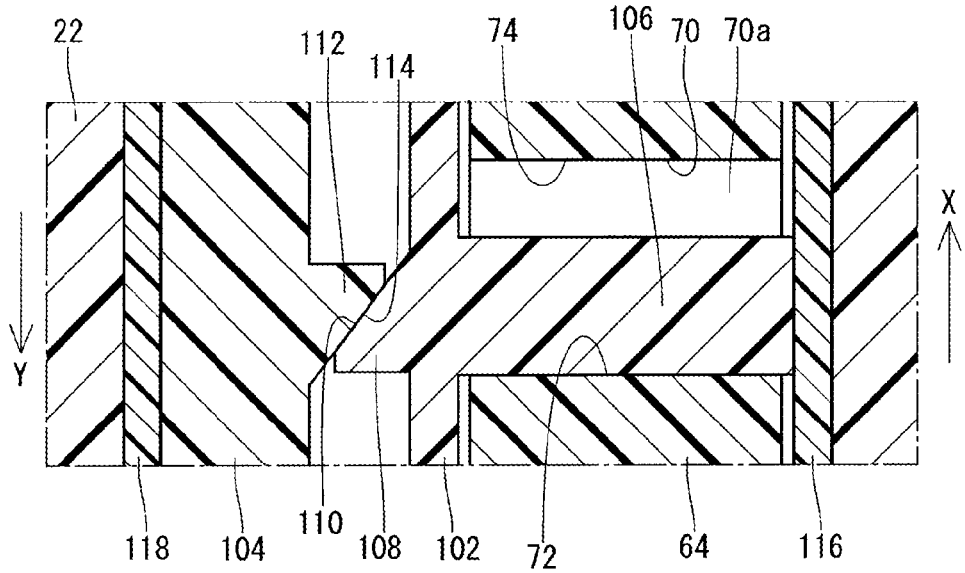
FIG. 5 is an enlarged cross-sectional view taken along line V-V in FIG. 2, showing a first rotor, a second rotor and a pedal boss portion of the accelerator apparatus.

The first-bevel-gear teeth 108 are formed integrally with an outer wall of the first rotor 102, which is located on the second rotor 104 side in the axial direction of the shaft 50. Each of the first-bevel-gear teeth 108 is configured such that an amount of projection of the first-bevel-gear tooth 108 toward the second rotor 104 in the axial direction of the shaft 50 is progressively increased in the accelerator-closing direction Y. As shown in FIG. 5, each first-bevel-gear tooth 108 has a sloped surface 110, which progressively approaches the second rotor 104 in the accelerator-closing direction Y.

The second-bevel-gear teeth 112 are formed integrally with an outer wall of the second rotor 104, which is located on the first rotor 102 side in the axial direction of the shaft 50. Each of the second-bevel-gear tooth 112 is configured such that an amount of projection of the second-bevel-gear tooth 112 toward the first rotor 102 in the axial direction of the shaft 50 is progressively increased in the accelerator-opening direction X. As shown in FIG. 5, each second-bevel-gear tooth 112 has a sloped surface 114, which progressively approaches the first rotor 102 in the accelerator-opening direction X.

When each of the first-bevel-gear teeth 108 contacts the corresponding one of the second-bevel-gear teeth 112 in the circumferential direction, the rotation can be transmitted between the first rotor 102 and the second rotor 104. Specifically, the rotation of the first rotor 102 in the accelerator-opening direction X can be conducted to the second rotor 104 through the first-bevel-gear teeth 108 and the second-bevel-gear teeth 112. Also, the rotation of the second rotor 104 in the accelerator-closing direction Y can be conducted to the first rotor 102 through the second-bevel-gear teeth 112 and the first-bevel-gear teeth 108.

Furthermore, when the rotational position of the first rotor 102 is located on a circumferential side of an accelerator-full-closing position of the first rotor 102 where an accelerator-full opening position of the first rotor 102 is located, the sloped surface of each of the first-bevel-gear teeth 108 engages the sloped surface of the corresponding one of the second-bevel-gear teeth 112 to urge the first rotor 102 and the second rotor 104 away from each other in the axial direction of the shaft 50. During the normal operation (i.e., the operation, during which each projection 106 and the first rotor 102 are not jammed and are thereby rotatable), when the manipulation member 60 is placed in the accelerator-full-closing position, which is indicated by the solid line in FIG. 3, the projections 106 and the first rotor 102, which are formed integrally, are placed in the accelerator-full-closing position of the projections 106 and of the first rotor 102 shown in FIG. 3. Also, during the normal operation, when the manipulation member 60 is placed in the accelerator-full-opening position, which is indicated by the dot-dot-dash line in FIG. 3, the projections 106 and the first rotor 102, which are formed integrally, are placed in the accelerator-full-opening position thereof. The accelerator-full-opening position of each of the projections 106 (and thereby of the first rotor 102) is circumferentially placed on the clockwise side of the position of the projection 106 shown in FIG. 3 and is circumferentially displaced from the position of the projection 106 shown in FIG. 3 by a corresponding angle, which correspond to an angular difference between the accelerator-full-closing position and the accelerator-full-opening position of the manipulation member 60 shown in FIG. 3.

When the rotational angle of the first rotor 102 from the accelerator-full-closing position of the first rotor 102 toward the accelerator-full-opening position of the first rotor 102 is increased, the urging force of the first-bevel-gear teeth 108, which urges the first rotor 102 toward the pedal boss portion 64 in the axial direction of the shaft 50, is increased. Furthermore, when the rotational angle of the first rotor 102 from the accelerator-full-closing position of the first rotor 102 toward the accelerator-full-opening position of the first rotor 102 is increased, the urging force of the second-bevel-gear teeth 112, which urges the second rotor 104 toward the bearing portion 22 of the housing 20 in the axial direction of the shaft 50, is increased.

The first friction member 116 is located radially outward of the shaft 50 and is placed between the projections 106 and the bearing portion 24 of the housing 20 in the axial direction of the shaft 50. The first friction member 116 is configured into an annular form (a circular disk form) and is fixed to distal ends of the projections 106. When the first rotor 102 is urged away from the second rotor 104 in the axial direction of the shaft 50, the projections 106 urge the first friction member 116 against the bearing portion 24 of the housing 20. At this time, the first friction member 116 frictionally engages the bearing portion 24. A frictional force between the first friction member 116 and the bearing portion 24 acts as a rotational resistance of the projections 106. When the urging force, which is applied to the first rotor 102 toward the pedal boss portion 64, is increased, a resistance torque, which is applied to the projections 106 from the bearing portion 24 through the first friction member 116, is increased.

The second friction member 118 is located radially outward of the shaft 50 and is placed between the second rotor 104 and the bearing portion 22 of the housing 20. The second friction member 118 is configured into an annular form (a circular disk form) and is fixed to the second rotor 104. When the second rotor 104 is urged away from the first rotor 102 in the axial direction of the shaft 50, the second rotor 104 urges the second friction member 118 against the bearing portion 22 of the housing 20. At this time, the second friction member 118 frictionally engages the bearing portion 22. A frictional force between the second friction member 118 and the bearing portion 22 acts as a rotational resistance of the second rotor 104. When the urging force, which is applied to the second rotor 104 toward the bearing portion 22, is increased, a resistance torque, which is applied to the second rotor 104 from the bearing portion 22 through the second friction member 118, is increased. The resistance torque, which is applied to the second rotor 104, is conducted to the projections 106 through the second-bevel-gear teeth 112, the first-bevel-gear teeth 108 and the first rotor 102.

One end portion of the second spring 120, which is formed as a coil spring, is engaged with a spring receiving member 122 that is engaged with a spring engaging portion 105 of the second rotor 104. The other end portion of the second spring 120 is engaged with the connecting portion 28 of the housing 20. The spring engaging portion 105 extends upwardly in the accommodating chamber 36. The second spring 120 urges the second rotor 104 in the accelerator-closing direction Y. An urging force of the second spring 120 is increased, when the rotational angle of the second rotor 104 from the accelerator-full-closing position (i.e., the position of the second rotor 104 shown in FIG. 4) in the accelerator-opening direction X is increased. A torque, which is applied to the second rotor 104 by the urging force of the second spring 120, is conducted to the projections 106 through the second-bevel-gear teeth 112, the first-bevel-gear teeth 108 and the first rotor 102.

The manipulation member 60 includes a spring-supporting portion 35, which extends from a distal end part of the full-closing-side stopper portion 82 toward the connecting portion 26. The spring-supporting portion 35 is placed on one side of the spring engaging portion 105 of the second rotor 104 in the accelerator-closing direction Y.

An inner peripheral wall of each of the through-holes 70 defines the projection-receiving space 70*a*, which is circumferentially elongated and receives the corresponding projection 106. Each of the projections 106 is circumferentially urged against the closing-side end wall 72 of the corresponding through-hole 70 by the urging force of the second spring 120. When the projection 106 contacts the closing-side end wall 72 of the through-hole 70, a space is formed on a circumferential side of the projection 106 in the accelerator-opening direction X. When the accelerator pedal 87 is rotated in the accelerator-opening direction X, the closing-side end wall 72 of each through-hole 70 contacts the corresponding projection 106 and conducts the resistance torque, which is received by the projection 106, to the pedal boss portion 64.

When the accelerator pedal 87 is rotated in the accelerator-closing direction Y, the pedal boss portion 64 can rotate to the accelerator-full-closing position without engaging the projections 106 in the circumferential direction. That is, the pedal boss portion 64 is rotatable relative to the housing 20 within a predetermined angular range from the accelerator-full-closing position to the accelerator-full-opening position. In contrast, the through-hole 70 is configured such that the pedal boss portion 64 can rotate relative to the projection 106 through an angular range that is larger than the predetermined angular range of the pedal boss portion 64, through which the pedal boss portion 64 can rotate relative to the housing 20.

Specifically, a circumferential length of the through-hole 70, which is measured circumferentially about the rotational axis of the shaft 50 from the closing-side end wall 72 of the through-hole 70 to the opening-side end wall 74 of the through-hole 70, is denoted as X1. A circumferential moving distance of the projection 106, which is measured circumferentially about the rotational axis of the shaft 50 from the accelerator-full-closing position to the accelerator-full-opening position, is denoted as X2. A circumferential length (specifically, an outer diameter in the case of the projection 106 having a circular cross section) of the projection 106, which is measured circumferentially about the rotational axis of the shaft 50, is denoted as X3. In such a case, the circumferential length X1 is set to be larger than a sum of the circumferential moving distance X2 and the circumferential length X3 (i.e., X1>X2+X3). Thereby, even when the projection 106 is fixed, i.e., fastened at the accelerator-full-opening position, the pedal boss portion 64 can move back to the accelerator-full-closing position without generating interference between the projection 106 and the pedal boss portion 64.

Next, the operation of the accelerator apparatus 10 will be described.

When the accelerator pedal 87 is depressed, the manipulation member 60 is rotated together with the shaft 50 about the rotational axis of the shaft 50 in the accelerator-opening direction X in response to the pedal force applied from the foot of the driver to the pad 86. At this time, in order to rotate the manipulation member 60 and the shaft 50, the pedal force needs to generate a torque that is larger than a sum of the torque, which is generated by the urging forces of the first and second springs 88, 120, and the resistance torque, which is generated by the frictional forces of the first and second friction members 116, 118.

When the accelerator pedal 87 is depressed, the resistance torque, which is generated by the frictional forces of the first and second friction members 116, 118, limits the rotation of the accelerator pedal 87 in the accelerator-opening direction X. Therefore, with reference to FIG. 6, the pedal force F (N) at the time of depressing the accelerator pedal 87 (see a solid line L1, which indicates the relationship between the pedal force F (N) and the rotational angle θ (degrees) at the time of depressing the accelerator pedal 87), is larger than the pedal force F (N) at the time of returning the accelerator pedal 87 toward the accelerator-full-closing position (see a dot-dash line L3, which indicates the relationship between the pedal force F (N) and the rotational angle θ (degrees) at the time of returning the accelerator pedal 87 toward the accelerator-full-closing position) even for the same rotational angle θ.

In order to maintain the depressed state of the accelerator pedal 87, it is only required to apply the pedal force that generates the torque, which is larger than a difference between the torque generated by the urging forces of the first and second springs 88, 120 and the resistance torque generated by the frictional forces of the first and second friction members 116, 118. In other words, when the driver wants to maintain the depressed state of the accelerator pedal 87 after depressing the accelerator pedal 87, the driver may reduce the applied pedal force by a certain amount.

Figure 6:
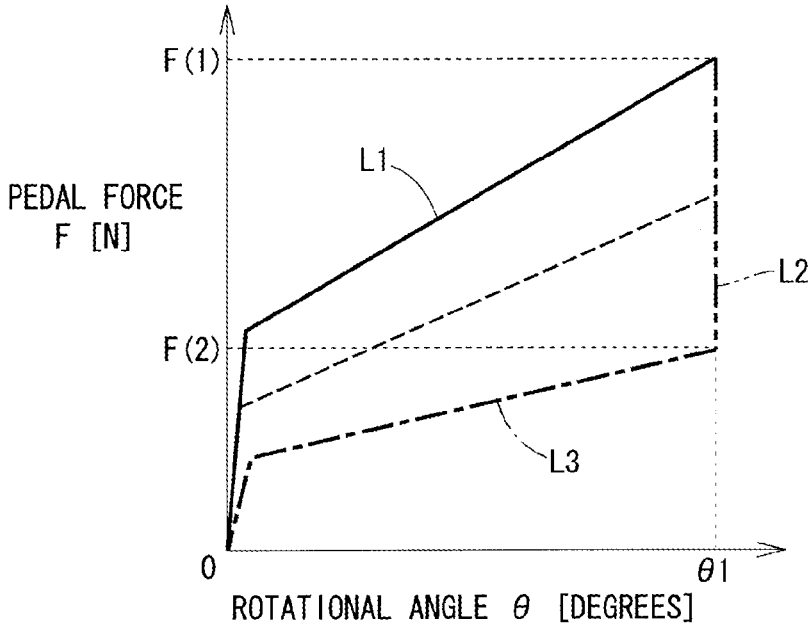
FIG. 6 is a diagram showing a relationship between a pedal force applied to an accelerator pedal and a rotational angle of the accelerator pedal at the accelerator apparatus of the first embodiment.

For example, as indicated by a dot-dot-dash line L2 in FIG. 6, in the case where the depressed state of the accelerator pedal 87, which is depressed to the rotational angle θ1, needs to be maintained, the pedal force may be reduced from the pedal force F(1) to the pedal force (F2). In this way, the depressed state of the accelerator pedal 87 can be easily maintained. The resistance torque, which is generated by the frictional forces of the first and second friction members 116, 118, is exerted to limit the rotation of the accelerator pedal 87 in the accelerator-closing direction Y at the time of maintaining the depressed state of the accelerator pedal 87.

In order to return the accelerator pedal 87 to the accelerator-full-closing position, the pedal force applied to the accelerator pedal 87 should generate a torque that is smaller than the difference between the torque, which is generated by the urging forces of the first and second springs 88, 120, and the resistance torque, which is generated by the frictional forces of the first and second friction members 116, 118. Here, at the time of returning the accelerator pedal 87 to the accelerator-full-closing position, it is only required to stop the depressing of the accelerator pedal 87 (i.e., required to fully release the accelerator pedal 87). Therefore, there is no burden to the driver. In contrast, when the accelerator pedal 87 is gradually returned toward the accelerator-full-closing position, it is required to apply a predetermined pedal force on the accelerator pedal 87. In the first embodiment, the pedal force, which is required to gradually return the accelerator pedal toward the accelerator-full-closing position, is relatively small.

For example, as indicated by the dot-dash line L3 in FIG. 6, in the case where the accelerator pedal 87, which is depressed to the rotational angle θ1, is gradually returned toward the accelerator-full-closing position, the pedal force may be adjusted between the pedal force F(2) and 0 (zero). The pedal force F(2) is smaller than the pedal force F(1). Therefore, when the depressed accelerator pedal 87 is returned toward the accelerator-full closing position, the burden on the driver is reduced. The resistance torque, which is generated by the frictional forces of the first and second friction members 116, 118, acts to limit the rotation of the accelerator pedal 87 in the accelerator-closing direction Y at the time of returning the accelerator pedal 87 toward the accelerator-full closing position. Therefore, as indicated in FIG. 6, the pedal force F at the time of returning the accelerator pedal 87 toward the accelerator-full-closing position (see the dot-dash line L3, which indicates the relationship between the pedal force F and the rotational angle θ at the time of returning the accelerator pedal 87 toward the accelerator-full-closing position) is smaller than the pedal force F at the time of depressing the accelerator pedal 87 (see the solid line L1, which indicates the relationship between the pedal force F and the rotational angle θ at the time of depressing the accelerator pedal 87) even for the same rotational angle θ.

Here, it is now assumed that the rotation of the first and second rotors 102, 104 is disabled (i.e., the first and second rotors 102, 104 become non-rotatable) due to, for example, clamping of a foreign object between the first friction member 116 and the bearing portion 24 of the housing 20 or between the second friction member 118 and the bearing portion 22 of the housing 20 or increasing of the frictional forces of the first and second friction members 116, 118 caused by an environmental change. In such a case, the urging force of the second spring 120 is not applied to the pedal boss portion 64. However, the urging force of the first spring 88 is applied to the pedal boss portion 64. The pedal boss portion 64 can be returned to the accelerator-full closing position by the urging force of the first spring 88 without causing an interference with the projections 106 even in the case where the first and second rotors 102, 104 become non-rotatable at the accelerator-full closing position due to, for example, the jamming.

As described above, in the accelerator apparatus 10 of the first embodiment, the pedal boss portion 64 of the manipulation member 60 includes the through-holes 70, each of which receives the corresponding projection 106 and is elongated in the circumferential direction. At the time of rotating the pedal boss portion 64 to the accelerator-full closing position, the pedal boss portion 64 can be rotated to the accelerator-full closing position without engaging with the projections 106 in the circumferential direction. Therefore, when the first rotor 102 becomes non-rotatable due to fastening (jamming) of the first and second friction members 116, 118, the pedal boss portion 64 can be rotated to the accelerator-full-closing position regardless of the rotational positions of the first rotor 102 and the projections 106. At this time, the urging force of the first spring 88 is exerted against the pedal boss portion 64. Therefore, when the depressed accelerator pedal 87 is fully released, the accelerator pedal 87 and the associated components rotated integrally therewith can be reliably returned to the accelerator-full-closing position.

Furthermore, in the first embodiment, the pedal boss portion 64 of the manipulation member 60 is rotatable relative to the housing 20 within the predetermined angular range from the accelerator-full-closing position to the accelerator-full-opening position. The through-holes 70 are formed such that the pedal boss portion 64 can be rotated relative to the projections 106 through the corresponding angular range, which is larger than the predetermined angular range discussed above. Therefore, when the first rotor 102 becomes non-rotatable due to the fastening (jamming) of at least one of the first and second friction members 116, 118, the pedal boss portion 64 can be rotated to the accelerator-full-closing position without causing the interference with the projections 106.

Furthermore, according to the first embodiment, the engaging portions of the pedal boss portion 64, which are circumferentially engageable with the projections 106, are formed by the inner peripheral walls of the through-holes 70. Therefore, in comparison to a case where the engaging portions of the pedal boss portion 64 are formed by inner walls of notched grooves, which are recessed in the outer peripheral surface of the pedal boss portion 64, the strength of the pedal boss portion 64 can be increased.

Furthermore, according to the first embodiment, the first spring 88 generates the urging force, which can return the shaft 50 and the manipulation member 60 to the accelerator-full-closing position. Thereby, in the case where the first rotor 102 becomes non-rotatable, and the urging force of the second spring 120 is not applied to the pedal boss portion 64, the shaft 50 and the manipulation member 60 can be reliably returned to the accelerator-full-closing position by the urging force of the first spring 88.

Furthermore, according to the first embodiment, the full-closing-side stopper portion 82 is received in the accommodating chamber 36, which is defined by the housing 20, the pedal boss portion 64 and the cover portions 78, 80. Therefore, it is possible to limit the clamping of the foreign object between the full-closing-side stopper portion 82 and the surface 38 of the connecting portion 26 of the housing 20. Therefore, at the time of releasing the depressed accelerator pedal 87 toward the accelerator-full-closing position, it is possible to avoid the occurrence of the non-returnable state of the accelerator pedal 87, at which the accelerator pedal 87 cannot be returned to the accelerator-full-closing position, and which is caused by, for example, the clamping of the foreign object between the full-closing-side stopper portion 82 and the surface 38 of the connecting portion 26.

Furthermore, according to the first embodiment, the full-closing-side stopper portion 82 is located at the upper side of the accommodating chamber 36. At the time of limiting the rotation of the shaft 50 in the accelerator-closing direction Y, the full-closing-side stopper portion 82 contacts the vertical surface 38 that extends in the top-to-bottom direction in the inner wall of the connecting portion 26 of the housing 20. Therefore, the foreign objects, such as abrasive particles, which are lifted into the upper area of the accommodating chamber 36, fall onto the lower side of the accommodating chamber 36 without adhering to the surface 38 of the connecting portion 26 of the housing 20. Thus, it is possible to limit the clamping of the foreign objects, which are located in the inside of the accommodating chamber 36, between the full-closing-side stopper portion 82 and the surface 38 of the connecting portion 26.

Furthermore, according to the first embodiment, in the case where the first spring 88 and the spring engaging portion 105 of the second rotor 104 are broken, the urging force of the second spring 120 is urged against the pedal boss portion 64 through the spring-supporting portion 35, which is engaged with the broken spring engaging portion 105. Therefore, in the case where the first spring 88 and the spring engaging portion 105 of the second rotor 104 are broken, the manipulation member 60 and the shaft 50 can be returned to the accelerator-full-closing position.

Second Embodiment

Figure 7:
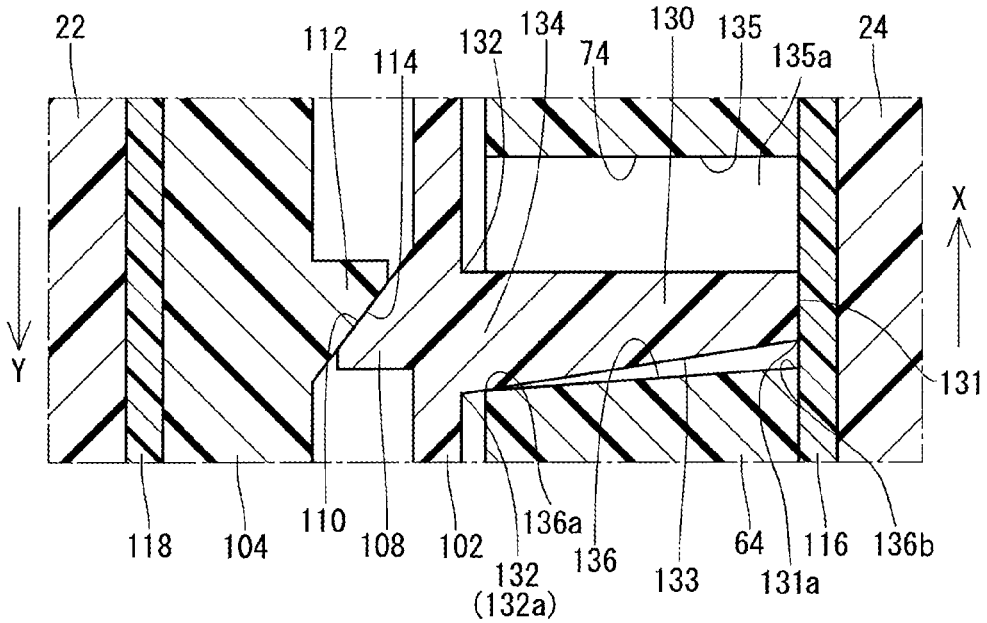
FIG. 7 is an enlarged partial cross-sectional view showing a first rotor, a second rotor and a pedal boss portion of an accelerator apparatus according to a second embodiment of the present disclosure.

An accelerator apparatus according to a second embodiment of the present disclosure will be described with reference to FIG. 7.

In the second embodiment, a circumferential distance between the projection 130 and the closing-side end wall 136 of the through-hole 135 (each through-hole 135 defining a projection-receiving space 135*a*, which receives the corresponding projection 130) is progressively reduced in the axial direction of the shaft 50 from the distal end 131 side of the projection 130 toward the base end 132 side of the projection 130. Specifically, a first outer wall 133 of the projection 130, which is placed on a circumferential side where the closing-side end wall 136 of the through-hole 135 is located, is tilted relative to the axial direction of the shaft 50 such that a base end 132*a* of the first outer wall 133 is circumferentially displaced from a distal end 131*a* of the first outer wall 133 in the accelerator-closing direction Y. Furthermore, the closing-side end wall 136 of the through-hole 135 is tilted relative to the axial direction of the shaft 50 such that one axial end 136*a* of the closing-side end wall 136, which is located on the one axial side (base side) where the base end 132 of the projection 130 is located, is circumferentially displaced from the other axial end 136*b* of the closing-side end wall 136, which is located on the other axial side (distal side) where the distal end 131 of the projection 130 is located, in the accelerator-closing direction Y. Furthermore, a degree of tilting of the closing-side end wall 136 of the through-hole 135 (relative to the axial direction of the shaft 50) is smaller than a degree of tilting of the first outer wall 133 of the projection 130 (relative to the axial direction of the shaft 50). The closing-side end wall 136 of the through-hole 135 serves as an engaging portion of the present disclosure.

Therefore, in the second embodiment, when the projection 130 contacts the closing-side end wall 136 of the through-hole 135, the closing-side end wall 136 contacts an outer wall of a base end portion 134 of the projection 130. Thereby, a bending stress, which is applied to the base end 132 of the projection 130, is reduced, and thereby the durability of the projection 130 can be improved, and a size of the projection 130 can be reduced.

Furthermore, according to the second embodiment, when each of the projections 130 and the closing-side end wall 136 of the corresponding one of the through-holes 135 are circumferentially engaged with each other (i.e., are circumferentially contacted with each other), the pedal boss portion 64 is urged by the first outer wall 133 of each projection 130 toward the first friction member 116 side in the axial direction of the shaft 50. At this time, the first friction member 116 receives the urging force of each projection 130 and the urging force of the pedal boss portion 64. Thereby, the resistance torque, which is applied to the pedal boss portion 64, is increased. Thus, it is possible to generate the pedal force hysteresis characteristics such that a relatively large pedal force difference exists between the time of depressing the accelerator pedal 87 and the time of returning the accelerator pedal 87 toward the accelerator-full-closing position.

Third Embodiment

Figure 8:
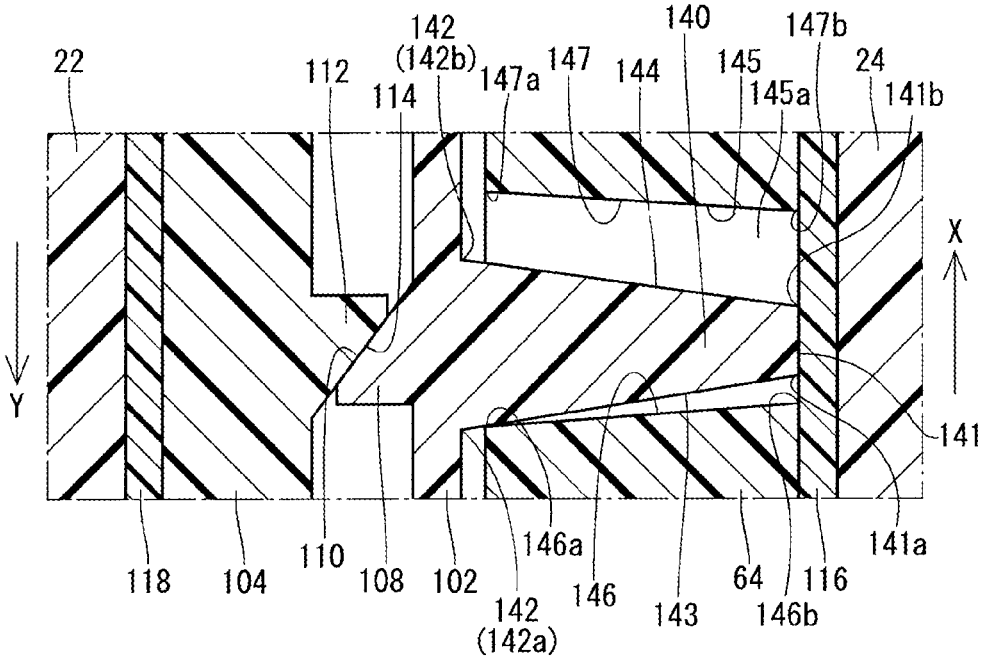
FIG. 8 is an enlarged partial cross-sectional view showing a first rotor, a second rotor and a pedal boss portion of an accelerator apparatus according to a third embodiment of the present disclosure.

An accelerator apparatus according to a third embodiment of the present disclosure will be described with reference to FIG. 8.

In the third embodiment, similar to the second embodiment, the circumferential distance between the projection 140 and the closing-side end wall 146 of the through-hole 145 (each through-hole 145 defining a projection-receiving space 145*a*, which receives the corresponding projection 140) is progressively reduced from the distal end 141 side of the projection 140 toward the base end 142 side of the projection 140 in the axial direction of the shaft 50. Specifically, a first outer wall 143 of the projection 140, which is placed on a circumferential side where the closing-side end wall 146 of the through-hole 145 is located, is tilted relative to the axial direction of the shaft 50 such that the base end 142*a* of the first outer wall 143 is circumferentially displaced from the distal end 141*a* of the first outer wall 143 of the projection 140 in the accelerator-closing direction Y. Furthermore, the closing-side end wall 146 of the through-hole 145 is tilted relative to the axial direction of the shaft 50 such that one axial end 146*a* of the closing-side end wall 146, which is located on the one axial side where the base end 142 of the projection 140 is located, is circumferentially displaced from the other axial end 146*b* of the closing-side end wall 146, which is located on the other axial side where the distal end 141 of the projection 140 is located, in the accelerator-closing direction Y. Furthermore, a degree of tilting of the closing-side end wall 146 of the through-hole 145 (relative to the axial direction of the shaft 50) is smaller than a degree of tilting of the first outer wall 143 of the projection 140 (relative to the axial direction of the shaft 50). The closing-side end wall 146 of the through-hole 145 serves as an engaging portion of the present disclosure.

Furthermore, a second outer wall 144 of the projection 140, which is circumferentially opposite from the first outer wall 143 of the projection 140, is tilted relative to the axial direction of the shaft 50 such that the base end 142*b* of the second outer wall 144 is circumferentially displaced from the distal end 141*b* of the second outer wall 144 in the accelerator-opening direction X. Furthermore, the opening-side end wall 147 of the through-hole 145, which is circumferentially opposite from the closing-side end wall 146 of the through-hole 145, is tilted relative to the axial direction of the shaft 50 such that one axial end 147*a* of the opening-side end wall 147, which is located on the one axial side where the base end 142 of the projection 140 is located, is circumferentially displaced from the other axial end 147*b* of the opening-side end wall 147, which is located on the other axial side where the distal end 141 of the projection 140 is located, in the accelerator-opening direction X. Furthermore, a degree of tilting of the opening-side end wall 147 of through-hole 145 (relative to the axial direction of the shaft 50) is smaller than a degree of tilting of the second outer wall 144 of the projection 140 (relative to the axial direction of the shaft 50).

Therefore, according to the third embodiment, the advantages, which are similar to those of the second embodiment, can be achieved. Furthermore, the strength of the base end 142 of the projection 140 is increased. Therefore, the durability of the projection 140 can be further improved, and the size of the projection 140 can be reduced.

Fourth Embodiment

Figure 9:
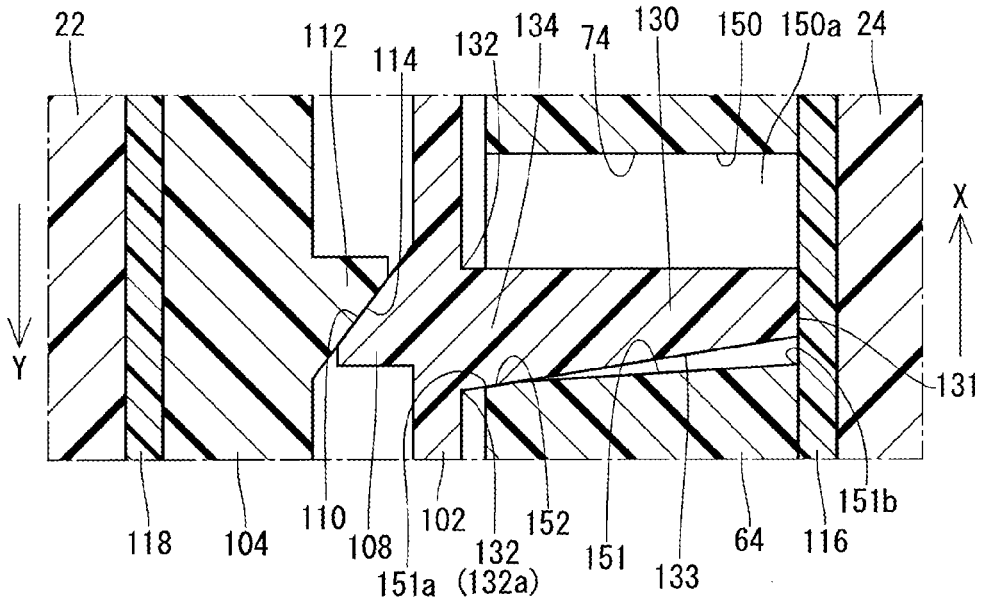
FIG. 9 is an enlarged partial cross-sectional view showing a first rotor, a second rotor and a pedal boss portion of an accelerator apparatus according to a fourth embodiment of the present disclosure.

An accelerator apparatus according to a fourth embodiment of the present disclosure will be described with reference to FIG. 9.

In the fourth embodiment, the shape of the closing-side end wall 151 of the through-hole 150 (each through-hole 150 defining a projection-receiving space 150*a*, which receives the corresponding projections 130) is different from the shape of the closing-side end wall 136 of the through-hole 135 of the second embodiment. Similar to the closing-side end wall 136 of the through-hole 135 of the second embodiment, the closing-side end wall 151 of the through-hole 150 is tilted relative to the axial direction of the shaft 50 such that one axial end 151*a* of the closing-side end wall 151 is circumferentially displaced from the other axial end 151*b* of the closing-side end wall 151 in the accelerator-closing direction Y. A degree of tilting of the closing-side end wall 151 (relative to the axial direction of the shaft 50) is smaller than the degree of tilting of the first outer wall 133 of the projection 130 (relative to the axial direction of the shaft 50). However, the shape of the axial end 151*a* side part of the closing-side end wall 151 differs from the shape of the axial end 136*a* side part of the closing-side end wall 136 of the second embodiment. Specifically, the closing-side end wall 151 has a contact surface 152, which is substantially parallel to a surface of the outer wall of the base end portion 134 of the projection 130 (a circumferentially opposed surface of the first outer wall 133 of the projection 130), which is circumferentially opposed to the contact surface 152 of the closing-side end wall 151. A tilt angle of the contact surface 152 relative to the axial direction of the shaft 50 is substantially the same as that of the outer wall of the base end portion 134 of the projection 130 (the circumferentially opposed surface of the first outer wall 133 of the projection 130), which is circumferentially opposed to the contact surface 152. When the outer wall of the base end portion 134 of the projection 130 contacts the closing-side end wall 151 of the through-hole 150, the circumferentially opposed outer wall of the base end portion 134 makes a surface-to-surface contact with the contact surface 152 of the closing-side end wall 151 of the through-hole 150. The closing-side end wall 151 serves as an engaging portion of the present disclosure.

Therefore, in the fourth embodiment, the pressure applied to the projection 130 and the pressure applied to the closing-side end wall 151 of the through-hole 150 can be reduced in comparison to the second embodiment where the projection 130 and the closing-side end wall 151 of the through-hole 150 make a point-to-point contact (or a line-to-line contact) therebetween. Therefore, it is possible to limit an increase in the amount of deformation with time at the contact between the projection 130 and the closing-side end wall 151, i.e., it is possible to limit the creep phenomenon. Thus, it is possible to limit a change in the pedal force hysteresis characteristics with time.

Fifth Embodiment

Figure 10:
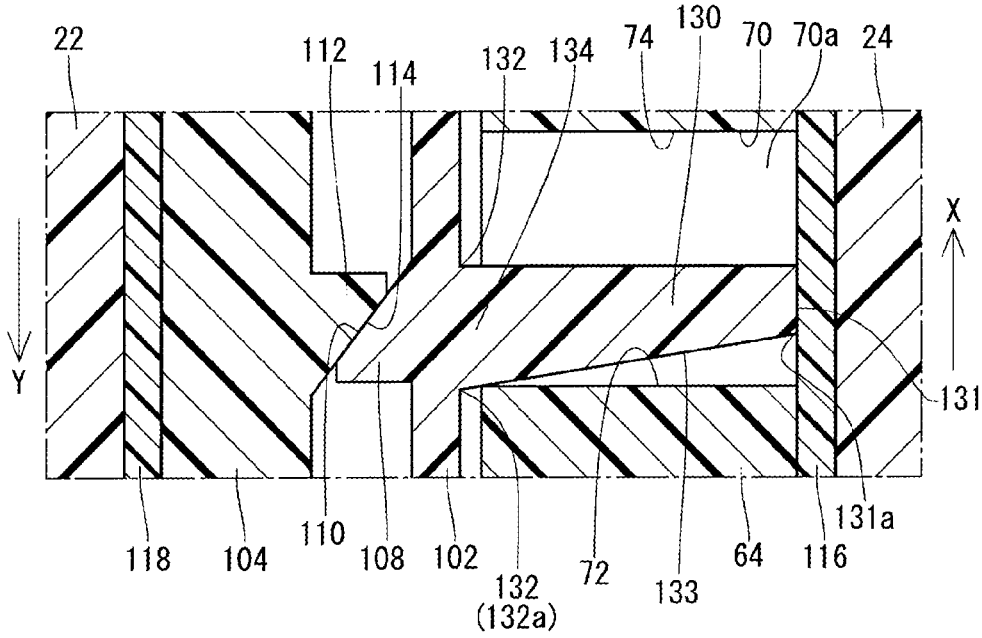
FIG. 10 is an enlarged partial cross-sectional view showing a first rotor, a second rotor and a pedal boss portion of an accelerator apparatus according to a fifth embodiment of the present disclosure.

An accelerator apparatus according to a fifth embodiment of the present disclosure will be described with reference to FIG. 10.

In the fifth embodiment, each through-hole 70 is the same as that of the first embodiment, and each projection 130 is the same as that of the second embodiment.

Even in the fifth embodiment, in which the closing-side end wall 72 of the through-hole 70 and an opening-side end wall 74 of the through-hole 70 are parallel to the rotational axis of the pedal boss portion 64 (i.e., the rotational axis of the shaft 50), the advantages similar to those of the second embodiment can be achieved.

Sixth Embodiment

Figure 11:
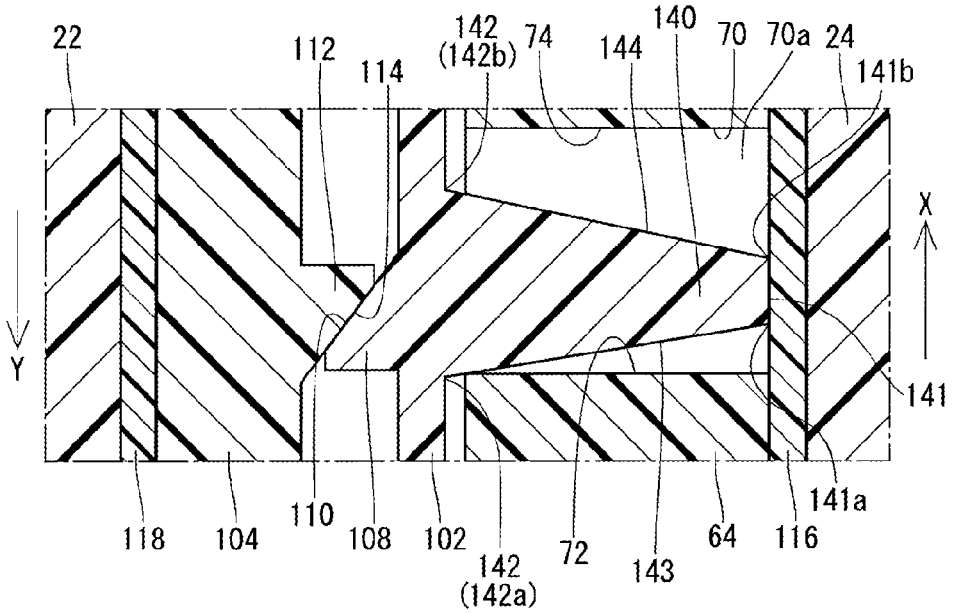
FIG. 11 is an enlarged partial cross-sectional view showing a first rotor, a second rotor and a pedal boss portion of an accelerator apparatus according to a sixth embodiment of the present disclosure.

An accelerator apparatus according to a sixth embodiment of the present disclosure will be described with reference to FIG. 11.

In the sixth embodiment, each through-hole 70 is the same as that of the first embodiment, and each projection 140 is the same as that of the third embodiment.

Even in the sixth embodiment, in which the closing-side end wall 72 of the through-hole 70 and the opening-side end wall 74 of the through-hole 70 are parallel to the rotational axis of the pedal boss portion 64 (i.e., the rotational axis of the shaft 50), the advantages similar to those of the third embodiment can be achieved.

Seventh Embodiment

Figure 12:
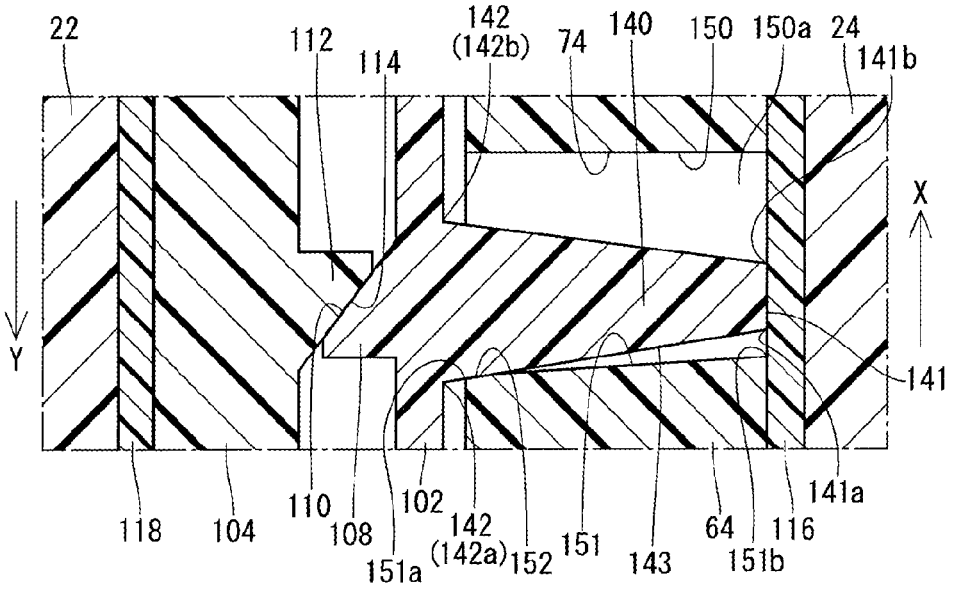
FIG. 12 is an enlarged partial cross-sectional view showing a first rotor, a second rotor and a pedal boss portion of an accelerator apparatus according to a seventh embodiment of the present disclosure.

An accelerator apparatus according to a seventh embodiment of the present disclosure will be described with reference to FIG. 12.

In the seventh embodiment, each through-hole 150 is the same as that of the fourth embodiment, and each projection 140 is the same as that of the third embodiment.

In comparison to the third embodiment, in which the projection 140 and the closing-side end wall 146 make the point-to-point contact (or the line-to-line contact) therebetween, according to the seventh embodiment, the pressure applied to the projection 140 and the pressure applied to the closing-side end wall 151 can be reduced. Therefore, it is possible to limit the creep phenomenon. Thus, it is possible to limit the change in the pedal force hysteresis characteristics with time.

Eighth Embodiment

Figure 13:
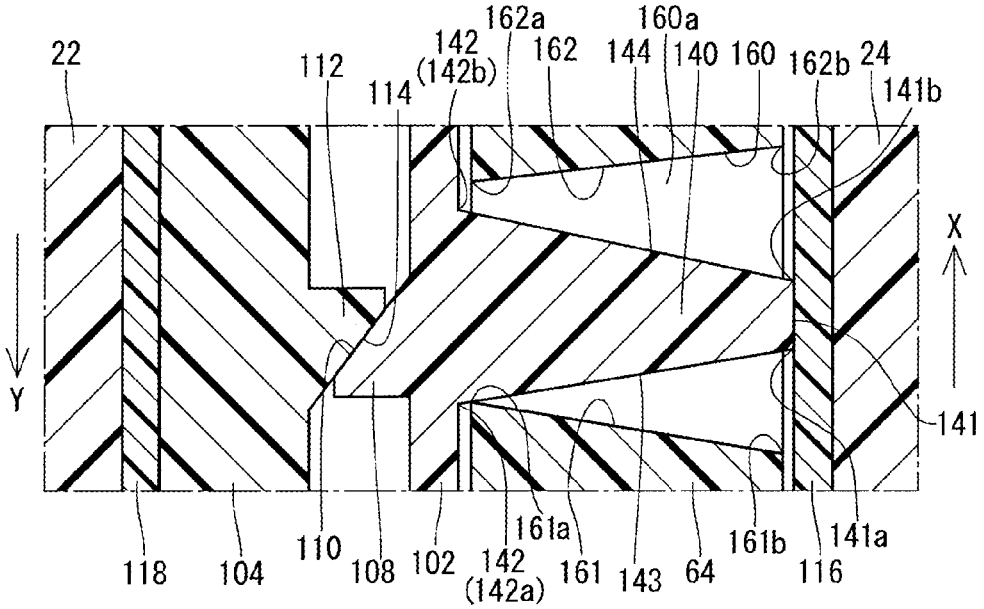
FIG. 13 is an enlarged partial cross-sectional view showing a first rotor, a second rotor and a pedal boss portion of an accelerator apparatus according to an eighth embodiment of the present disclosure.

An accelerator apparatus according to an eighth embodiment of the present disclosure will be described with reference to FIG. 13.

In the eighth embodiment, each projection 140 is the same as that of the third embodiment. Furthermore, the closing-side end wall 161 of the through-hole 160 (each through-hole 160 defining a projection-receiving space 160*a*, which receives the corresponding projection 140) is tilted relative to the axial direction of the shaft 50 such that one axial end 161*a* of the closing-side end wall 161, which is located on the one axial side where the base end 142 of the projection 140 is located, is circumferentially displaced from the other axial end 161*b* of the closing-side end wall 161, which is located on the other axial side where the distal end 141 of the projection 140 is located, in the accelerator-opening direction X. Furthermore, the opening-side end wall 162 of the through-hole 160 is tilted relative to the axial direction of the shaft 50 such that one axial end 162*a* of the opening-side end wall 162, which is located on the one axial side where the base end 142 of the projection 140 is located, is circumferentially displaced from the other axial end 162*b* of the opening-side end wall 162, which is located on the other axial side where the distal end 141 of the projection 140 is located, in the accelerator-closing direction Y.

Even in the eighth embodiment, in which the tilting direction of the closing-side end wall 161 and the tilting direction of the opening-side end wall are opposite from those of the third embodiment, the advantages, which are similar to those of the third embodiment, can be achieved.

Ninth Embodiment

Figure 14:
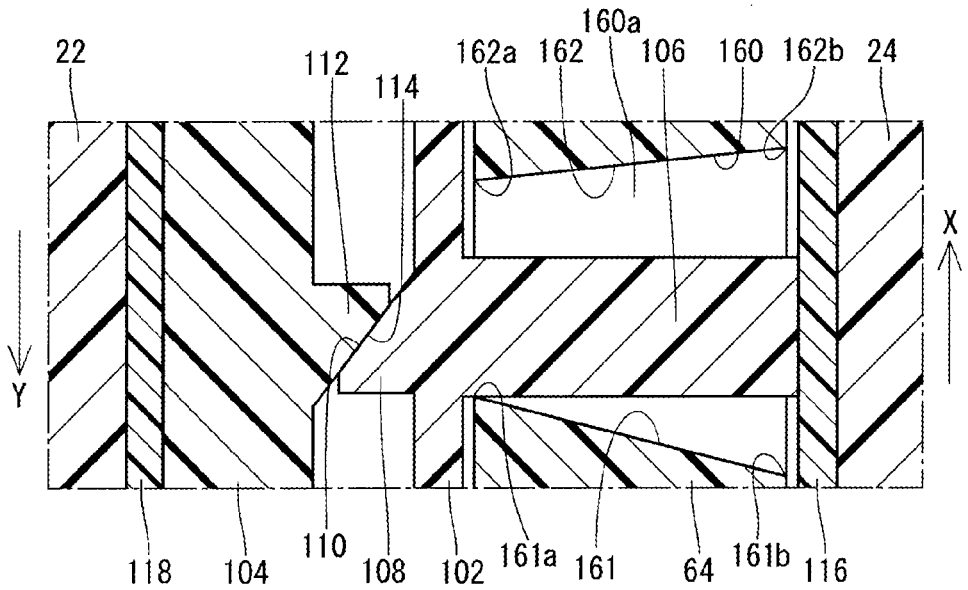
FIG. 14 is an enlarged partial cross-sectional view showing a first rotor, a second rotor and a pedal boss portion of an accelerator apparatus according to a ninth embodiment of the present disclosure.

An accelerator apparatus according to a ninth embodiment of the present disclosure will be described with reference to FIG. 14.

In the ninth embodiment, each projection 106 is the same as that of the first embodiment, and each through-hole 160 is the same as that of the eighth embodiment.

Even in the ninth embodiment, in which the closing-side end wall 161 and the opening-side end wall 162 are not parallel to the rotational axis of the pedal boss portion 64 (the rotational axis of the shaft 50), the advantages, which are similar to those of the first embodiment, can be achieved.

Tenth Embodiment

Figure 15:
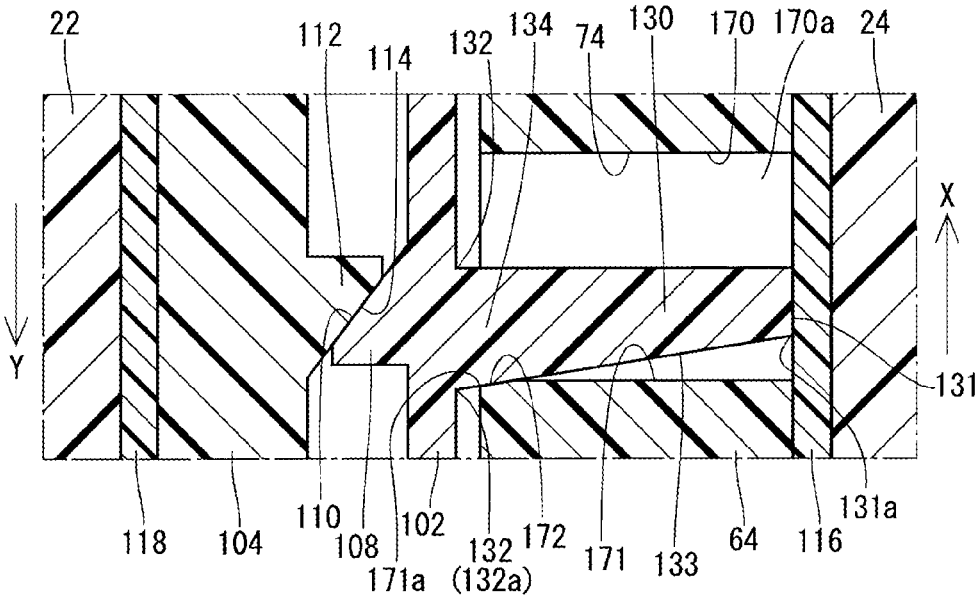
FIG. 15 is an enlarged partial cross-sectional view showing a first rotor, a second rotor and a pedal boss portion of an accelerator apparatus according to a tenth embodiment of the present disclosure.

An accelerator apparatus according to a tenth embodiment of the present disclosure will be described with reference to FIG. 15.

In the tenth embodiment, the shape of the closing-side end wall 171 of the through-hole 170 (each through-hole 170 defining a projection-receiving space 170*a*, which receives the corresponding projection 130) is different from the shape of the closing-side end wall 72 of the through-hole 70 of the fifth embodiment. Similar to the closing-side end wall 72 of the through-hole 70 of the fifth embodiment, the closing-side end wall 171 of the through-hole 170 of the present embodiment is generally parallel to the rotational axis of the pedal boss portion 64 (the rotational axis of the shaft 50). However, the shape of one axial end 171*a* side part of the closing-side end wall 171 differs from that of the closing-side end wall 72 of the fifth embodiment. Specifically, the closing-side end wall 171 has a contact surface 172, which is substantially parallel to the outer wall of the base end portion 134 of the projection 130 (the circumferentially opposed surface of the first outer wall 133 of the projection 130), which is circumferentially opposed to the contact surface 172 of the closing-side end wall 171. A tilt angle of the contact surface 172 relative to the axial direction of the shaft 50 is substantially the same as that of the outer wall of the base end portion 134 of the projection 130 (the circumferentially opposed surface of the first outer wall 133 of the projection 130), which is circumferentially opposed to the contact surface 172. When the outer wall of the base end portion 134 of the projection 130 contacts the closing-side end wall 171 of the through-hole 170, the circumferentially opposed outer wall of the base end portion 134 makes a surface-to-surface contact with the contact surface 172 of the closing-side end wall 171 of the through-hole 170. The closing-side end wall 171 of the through-hole 170 serves as an engaging portion of the present disclosure.

Therefore, in the tenth embodiment, the pressure applied to the projection 130 and the pressure applied to the closing-side end wall 171 of the through-hole 170 can be reduced in comparison to the fifth embodiment where the projection 130 and the closing-side end wall 72 of the through-hole 70 make the point-to-point contact (or the line-to-line contact) therebetween. Therefore, it is possible to limit the creep phenomenon. Thus, it is possible to limit the change in the pedal force hysteresis characteristics with time.

Eleventh Embodiment

Figure 16:
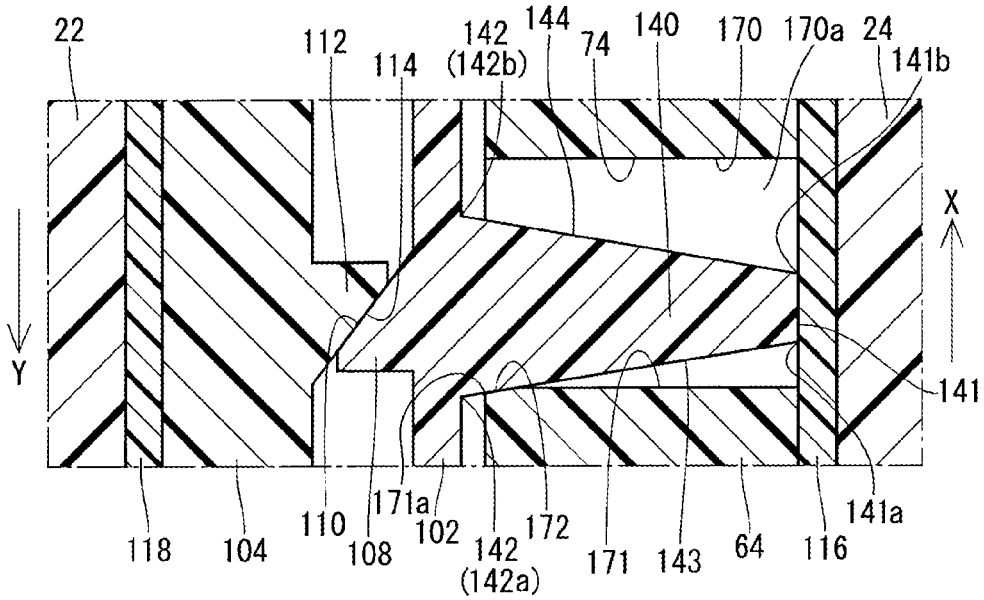
FIG. 16 is an enlarged partial cross-sectional view showing a first rotor, a second rotor and a pedal boss portion of an accelerator apparatus according to an eleventh embodiment of the present disclosure.

An accelerator apparatus according to an eleventh embodiment of the present disclosure will be described with reference to FIG. 16.

In the eleventh embodiment, each projection 140 is the same as that of the third embodiment, and each through-hole 170 is the same as that of the tenth embodiment.

According to the eleventh embodiment, the advantages, which are similar to those of the tenth embodiment can be achieved.

Twelfth Embodiment

Figure 17:
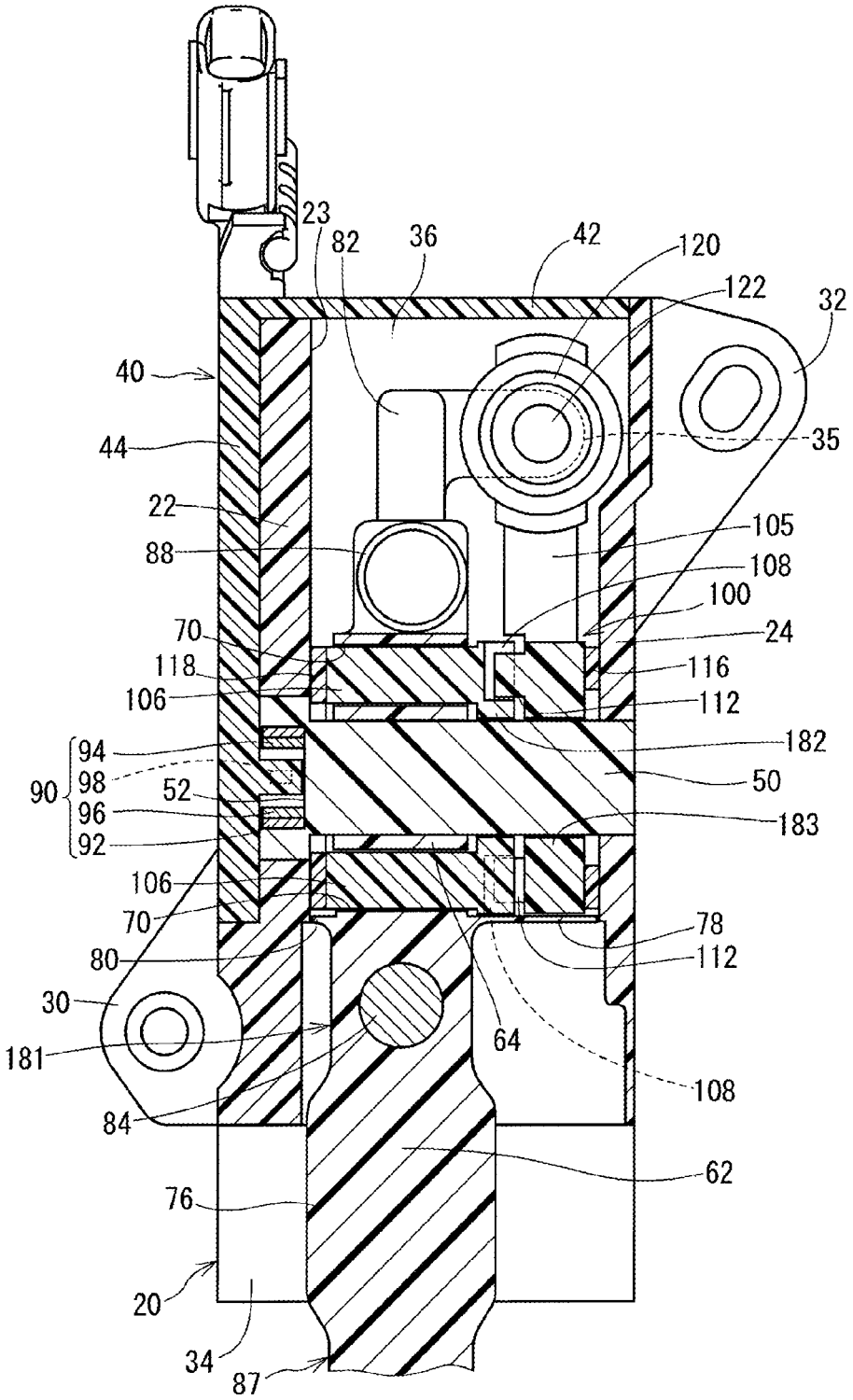
FIG. 17 is a cross-sectional view of an accelerator apparatus of a twelfth embodiment of the present disclosure, showing a cross section of the accelerator apparatus similar to FIG. 2 of the first embodiment.

An accelerator apparatus according to a twelfth embodiment of the present disclosure will be described with reference to FIG. 17.

According to the twelfth embodiment, the structures of the manipulation member 181, the first rotor 182 and the second rotor 183 are different from those of the first embodiment. The manipulation member 181 is configured into a shape of FIG. 17, which is implemented by inverting the manipulation member 181 in the axial direction. Furthermore, the first rotor 182 is configured into a shape of FIG. 17, which is implemented by inverting the first rotor 102 in the axial direction. Furthermore, the second rotor 183 is configured into a shape of FIG. 17, which is implemented by inverting the second rotor 104 in the axial direction.

According to the twelfth embodiment, the advantages, which are similar to those of the first embodiment can be achieved.

Thirteenth Embodiment

Figure 18:
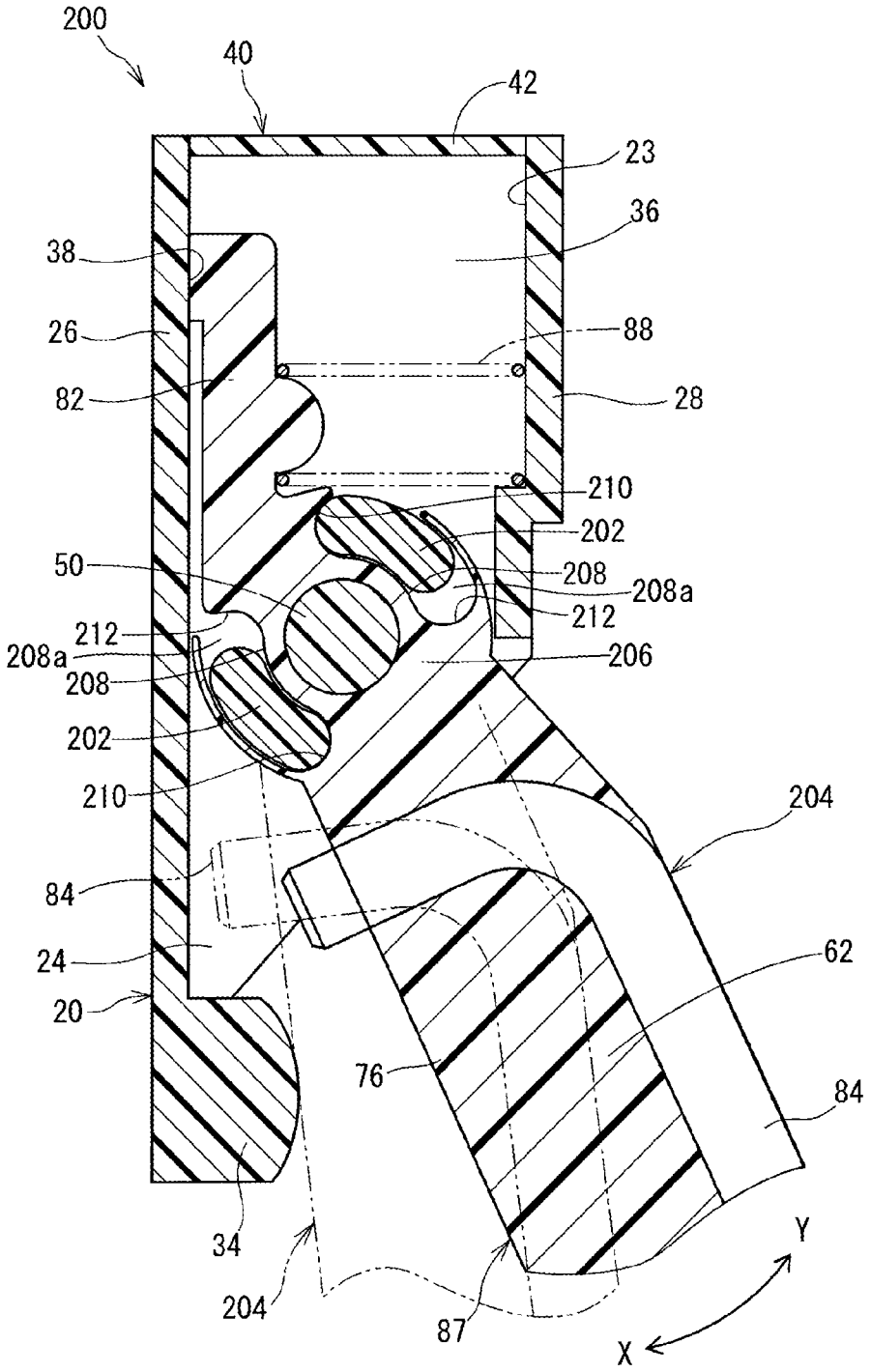
FIG. 18 is a cross-sectional view of an accelerator apparatus of a thirteenth embodiment of the present disclosure, showing a cross section of the accelerator apparatus similar to FIG. 3 of the first embodiment.

FIG. 18 shows an accelerator apparatus according to a thirteenth embodiment of the present disclosure. The accelerator apparatus 200 of the thirteenth embodiment differs from the accelerator apparatus 10 of the first embodiment with respect to the structures of the projections 202, the manipulation member 204 and the pedal boss portion 206.

As shown in FIG. 18, according to the present embodiment, the number of projections 202 is two. Each projection 202 is configured to have an arcuate cross section that circumferentially extends in a plane, which is perpendicular to the rotational axis of the shaft 50. The projections 202 are arranged one after another at generally equal intervals in the circumferential direction. Each of the projections 202 is received through a corresponding one of two notched grooves 208 (each notched groove 208 defining a projection-receiving space 208*a*, which receives the corresponding projection 202) formed in the pedal boss portion 206 and axially projects on a side of the pedal boss portion 206, which is opposite from the first rotor 102 in the axial direction of the shaft 50. The projection 202 can circumferentially engage a closing-side end wall 210 of the notched groove 208 in the accelerator-closing direction Y. The closing-side end wall 210 serves as an engaging portion of the present disclosure.

The closing-side end wall 210 of the notched groove 208 and the projection 202 can engage with each other in the circumferential direction to transmit the rotation (rotational force) between the manipulation member 204 and the first rotor 102. Specifically, the rotation of the manipulation member 204 in the accelerator-opening direction X can be conducted to the first rotor 102 through the closing-side end wall 210 of each notched groove 208 and the corresponding projection 202. Furthermore, the rotation of the first rotor 102 in the accelerator-closing direction Y can be conducted to the manipulation member 204 through each projection 202 and the closing-side end wall 210 of the corresponding notched groove 208.

The inner wall of each notched groove 208 defines the circumferential gap (the projection-receiving space 208*a*), which circumferentially extends and receives the corresponding projection 202. Each of the projections 202 is circumferentially urged against the closing-side end wall 210 of the corresponding notched groove 208 by the urging force of the second spring 120. When the projection 202 contacts the closing-side end wall 210 of the notched groove 208, a space is formed on a circumferential side of the projection 202 in the accelerator-opening direction X. When the accelerator pedal 87 is rotated in the accelerator-opening direction X, the closing-side end wall 210 of the notched groove 208 contacts the projection 202 and conducts the resistance torque, which is received from each corresponding friction member 116, 118 through the projection 202, to the pedal boss portion 206.

Each notched groove 208 is configured such that the pedal boss portion 206 can rotate to the accelerator-full-closing position without causing the engagement of the pedal boss portion 206 with the projection 202 in the circumferential direction at the time of rotating the accelerator pedal 87 in the accelerator-closing direction Y. That is, the pedal boss portion 206 is rotatable relative to the housing 20 within a predetermined angular range from the accelerator-full-closing position to the accelerator-full-opening position. In contrast, the notched groove 208 is configured such that the pedal boss portion 206 can rotated relative to the projection 202 through an angular range that is larger than the predetermined angular range of the pedal boss portion 206, through which the pedal boss portion 206 can rotate relative to the housing 20.

Specifically, a circumferential length of the notched groove 208, which is measured circumferentially about the rotational axis of the shaft 50 from the closing-side end wall 210 of the notched groove 208 to the opening-side end wall 212 of the notched groove 208, is denoted as Y1. A circumferential moving distance of the projection 202, which is measured circumferentially about the rotational axis of the shaft 50 from the accelerator-full-closing position to the accelerator-full-opening position, is denoted as Y2. A circumferential length of the projection 202, which is measured circumferentially about the rotational axis of the shaft 50, is denoted as Y3. In such a case, the circumferential length Y1 is set to be larger than a sum of the circumferential moving distance Y2 and the circumferential length Y3 (i.e., Y1>Y2+Y3). In this way, even when the projection 202 is fastened (is stuck) at the accelerator full-opening position, the pedal boss portion 206 can rotate to the accelerator-full-closing position without causing interference between the pedal boss portion 206 and the projection 202.

Next, the operation of the accelerator apparatus 200 will be described.

For instance, it is now assumed that the rotation of the first and second rotors 102, 104 is disabled (i.e., the first and second rotors 102, 104 become non-rotatable) due to, for example, clamping of a foreign object between the first friction member 116 and the bearing portion 24 of the housing 20 or between the second friction member 118 and the bearing portion 22 of the housing 20 or increasing of the frictional forces of the first and second friction members 116, 118 caused by an environmental change. In such a case, the urging force of the second spring 120 is not applied to the pedal boss portion 206. However, the urging force of the first spring 88 is applied to the pedal boss portion 206. The pedal boss portion 206 can be returned to the accelerator-full closing position by the urging force of the first spring 88 without causing interference with the projections 202 even in the case where the first and second rotors 102, 104 become non-rotatable at the accelerator-full closing position.

As described above, in the accelerator apparatus 200 of the thirteenth embodiment, the pedal boss portion 206 of the manipulation member 204 includes the notched grooves 208, each of which receives the corresponding projection 202 and is elongated in the circumferential direction. At the time of rotating the pedal boss portion 64 to the accelerator-full closing position, the pedal boss portion 64 can be rotated to the accelerator-full closing position without engaging with the projections 202 in the circumferential direction.

Therefore, when the first rotor 102 becomes non-rotatable due to fastening (jamming) of the first and second friction members 116, 118, the pedal boss portion 206 can be rotated to the accelerator-full-closing position regardless of the rotational positions of the first rotor 102 and the projections 202. At this time, the urging force of the first spring 88 is exerted against the pedal boss portion 206. Therefore, similar to the first embodiment, when the depressed accelerator pedal 87 is fully released, the accelerator pedal 87 and the associated components rotated integrally therewith can be reliably returned to the accelerator-full-closing position.

Now, modifications of the above embodiments will be described.

In a modification of the above embodiments, the projections 106, 130, 140, 202 do not need to be arranged at generally equal intervals in the circumferential direction.

Furthermore, the number of the projections 106, 130, 140 does not need to be four. It is only required to form two or more projections, which are arranged one after another in the circumferential direction.

Also, in another modification of the above embodiments, the projections 106, 130, 140, 202 may be formed separately from the first rotor 102, 182.

Furthermore, in another modification of the above embodiments, the full-closing-side stopper portion 82 may not need to be received in the accommodating chamber 36 formed by the housing 20. Furthermore, in the case where the full-closing-side stopper portion 82 is received in the accommodating chamber 36 of the housing 20, it is not required to place the full-closing-side stopper portion 82 in the upper side area of the accommodating chamber 36.

Furthermore, in another modification of the above embodiments, it is possible to provide an insensible area, in which the depression of the accelerator pedal is not sensed. The insensible area may be from the contact point, at which the full-closing-side stopper portion 82 contacts the housing 20, to a predetermined angular point, which is displaced from the contact point by a predetermined angle in the accelerator-opening direction X. The accelerator-full-closing position may be set at this position, which is displaced from the contact point, at which the full-closing-side stopper portion 82 contacts the housing 20, by the predetermined angle in the accelerator-opening direction X.

Furthermore, in another modification of the above embodiments, the first friction member 116 may be fixed to the housing 20. Also, the second friction member 118 may be fixed to the housing 20.

Also, in another modification of the above embodiments, the first spring 88 and the second spring 120 may not need to be the coil springs. For instance, the first spring and/or the second spring may be made of any other appropriate urging member, such as a leaf spring, a torsion spring.

Also, in another modification of the above embodiments, the first spring may be provided more than one (i.e., providing a plurality of first springs). Also, the second spring may be provided more than one (i.e., providing a plurality of second springs).

Furthermore, in another modification of the above embodiments, the first spring 88 may be engaged to, for example, the pedal boss portion 64, 206 or the accelerator pedal 87. The first spring 88 is only required to urge the accelerator pedal or the member, which is rotated integrally with the accelerator pedal.

Furthermore, in another modification of the above embodiments, the rotational position sensor 90 does not need to use the magnet 96 and the Hall element. As long as the rotational position sensor can sense the rotational position of the shaft 50, any other appropriate type of rotational sensor may be used.

The present disclosure is not limited the above embodiments and modifications thereof. That is, the above embodiments and modifications thereof may be modified in various ways without departing from the sprit and scope of the present disclosure.

What is claimed is:

1. An accelerator apparatus for a vehicle, comprising:

a support member that is installable to a body of the vehicle;

a shaft that is rotatably installed to the support member;

a pedal boss that is placed coaxial with the shaft and is rotatable integrally with the shaft;

an accelerator pedal that is connected to the pedal boss and rotates the pedal boss in response to an amount of depression of the accelerator pedal;

a first urging device that urges the pedal boss in an accelerator-closing direction;

a rotational angle sensing device that senses a rotational angle of the shaft relative to the support member;

a first rotor that is placed radially outward of the shaft and is rotatable relative to the pedal boss;

a second rotor that is placed radially outward of the shaft and is located on a side of the first rotor, which is opposite from the pedal boss, wherein the second rotor is rotatable relative to the first rotor;

a projection that is formed integrally with the first rotor on a side of the first rotor where the pedal boss is located, wherein the projection projects from the first rotor toward the pedal boss and is circumferentially engageable with an engaging portion provided in the pedal boss;

a plurality of first-bevel-gear teeth, which are formed integrally with the first rotor on a side of the first rotor where the second rotor is located, wherein an amount of projection of each of the plurality of first-bevel-gear teeth toward the second rotor progressively increases in the accelerator-closing direction in the circumferential direction;

a plurality of second-bevel-gear teeth, which are formed integrally with the second rotor on a side of the second rotor where the first rotor is located, wherein an amount of projection of each of the plurality of second-bevel-gear teeth toward the first rotor side progressively increases in an accelerator-opening direction in the circumferential direction, and when the first rotor is positioned on a side of an accelerator-full-closing position of the first rotor where an accelerator-full-opening position of the first rotor is located, the plurality of second-bevel-gear teeth engages and cooperates with the plurality of first-bevel-gear teeth, respectively, to urge the first rotor and the second rotor away from each other in an axial direction of the shaft;

a second urging device that urges the second rotor in the accelerator-closing direction;

a first friction member that is placed between the projection and the support member, wherein when the first rotor is urged away from the second rotor, the first friction member is frictionally engaged with the projection or the support member to apply a resistance torque to the projection; and a second friction member that is placed between the second rotor and the support member, wherein when the second rotor is urged away from the first rotor, the second friction member is frictionally engaged with the second rotor or the support member to apply a resistance torque to the second rotor, wherein:

the pedal boss has a space, which is located on a side of the engaging portion in the accelerator-opening direction and receives the projection, and when the pedal boss is rotated in the accelerator-closing direction, the pedal boss is rotatable to an accelerator-full-closing position of the pedal boss without being engaged with the projection regardless of a rotational position of the projection.

2. The accelerator apparatus according to claim 1, wherein:

the pedal boss is rotatable relative to the support member from the accelerator-full-closing position of the pedal boss to an accelerator-full-opening position of the pedal boss through a predetermined angular range; and the space is formed to enable rotation of the pedal boss relative to the projection through an angular range, wherein the angular range is larger than the predetermined angular range.

3. The accelerator apparatus according to claim 1, wherein the space is defined by an inner peripheral wall of a through-hole that extends in the axial direction.

4. The accelerator apparatus according to claim 1, wherein the first urging device exerts an urging force that enables returning of the shaft, the pedal boss and the accelerator pedal to the accelerator-full-closing position.

5. The accelerator apparatus according to claim 1, further comprising a full-closing-side stopper that rotates integrally with the shaft and limits rotation of the shaft in the accelerator-closing direction at the accelerator-full-closing position when the full-closing-side stopper contacts the support member, wherein the support member includes an accommodating portion, which accommodates the full-closing-side stopper.

6. The accelerator apparatus according to claim 5, wherein:

the full-closing-side stopper is located in an upper part of an accommodating space, which is formed in the accommodating portion of the support member; and when rotation of the shaft in the accelerator-closing direction is limited, the full-closing-side stopper contacts a part of an inner wall of the accommodating portion, which extends in a top-to-bottom direction.

7. The accelerator apparatus according to claim 1, wherein a circumferential distance between the projection and the engaging portion is progressively reduced from a distal end of the projection toward a base end of the projection.

8. The accelerator apparatus according to claim 1, wherein a first outer wall of the projection, which is located on a circumferential side where the engaging portion is located, is tilted to progressively project in the accelerator closing direction from a distal end of the projection toward a base end of the projection.

9. The accelerator apparatus according to claim 1, wherein a second outer wall of the projection, which is located on a circumferential side that is circumferentially opposite from the engaging portion, is tilted to progressively project in the accelerator opening direction from a distal end of the projection toward a base end of the projection.

10. The accelerator apparatus according to claim 1, wherein when the engaging portion contacts a base end portion of the projection, a line-to-line contact or a surface-to-surface contact is made between the engaging portion and the projection.

* * * * *